US012018489B2

(12) United States Patent
Majocka et al.

(10) Patent No.: US 12,018,489 B2
(45) Date of Patent: Jun. 25, 2024

(54) DOMED ROOF DRAIN STRAINER ASSEMBLY

(71) Applicant: Zurn Industries, LLC, Milwaukee, WI (US)

(72) Inventors: Christopher Alan Majocka, Erie, PA (US); Matthew Curtis Henderson, Girard, PA (US); Christopher Joseph Say, Waterford, PA (US)

(73) Assignee: ZURN WATER, LLC, Milwaukee, WI (US)

( * ) Notice: Subject to any disclaimer, the term of this patent is extended or adjusted under 35 U.S.C. 154(b) by 0 days.

(21) Appl. No.: 17/192,688

(22) Filed: Mar. 4, 2021

(65) Prior Publication Data

US 2021/0317666 A1 Oct. 14, 2021

Related U.S. Application Data

(60) Provisional application No. 63/009,894, filed on Apr. 14, 2020.

(51) Int. Cl.
*E04D 13/04* (2006.01)

(52) U.S. Cl.
CPC .. *E04D 13/0409* (2013.01); *E04D 2013/0413* (2013.01)

(58) Field of Classification Search
None
See application file for complete search history.

(56) References Cited

U.S. PATENT DOCUMENTS

| | | | | |
|---|---|---|---|---|
| 60,153 | A | 12/1866 | Diven | |
| 134,978 | A * | 1/1873 | Clapp | B01D 29/19 210/163 |
| 149,489 | A * | 4/1874 | Lewis | B01D 29/05 210/247 |
| 231,480 | A * | 8/1880 | Downes | B01D 21/02 210/166 |
| 550,460 | A | 11/1895 | Shanks | |
| 581,893 | A * | 5/1897 | Tucker | E04D 13/04 4/219 |
| 810,879 | A | 1/1906 | Perry | |
| 853,598 | A * | 5/1907 | Rile | E04D 13/0409 210/166 |
| 902,104 | A | 10/1908 | Neireiter | |

(Continued)

FOREIGN PATENT DOCUMENTS

| | | | |
|---|---|---|---|
| GB | 2347451 | A | 9/2000 |
| WO | WO2017182711 | A1 | 10/2017 |

OTHER PUBLICATIONS

Wade-Roof-Drain-ID-Selection-Guide; pp. 219-278; Wade Drains, Dated Jan. 1, 2019. (Year: 2019).*

(Continued)

*Primary Examiner* — Robert J Popovics
(74) *Attorney, Agent, or Firm* — Husch Blackwell LLP

(57) ABSTRACT

A roof drain including a base defining a channel and an axis, a gravel guard coupled to the base and including a plurality of teeth, where the gravel guard defines a plurality of gullets between the teeth, and a dome coupled to the base, where the dome includes a plurality of ribs, where the ribs define a plurality of gaps therebetween, and where each gap is radially aligned with a corresponding gullet.

9 Claims, 34 Drawing Sheets

(56) References Cited

U.S. PATENT DOCUMENTS 902,289 A * 10/1908 Gribben et al. ..... F24F 13/02 4/219
1,099,069 A * 6/1914 Matthews et al. ..... E03F 5/042 137/527.6
1,150,231 A * 8/1915 Smith ..... E04D 13/0409 285/136.1
1,180,018 A * 4/1916 Degnan ..... E04D 13/0409 285/43
1,195,827 A * 8/1916 Lucke ..... E03C 1/22 210/163
1,252,548 A * 1/1918 Carlson ..... E03F 5/0404 210/163
1,252,573 A * 1/1918 Holt ..... E04D 13/0409 277/606
1,266,948 A * 5/1918 Holt ..... E04D 13/0409 210/166
1,342,918 A 6/1920 Legg
1,348,945 A * 8/1920 Hirshstein ..... E04D 13/0409 210/166
1,380,793 A * 6/1921 Goldman ..... E04D 13/0409 285/123.3
1,434,254 A * 10/1922 Sanders ..... E04D 13/0409 210/163
1,487,161 A * 3/1924 Holt ..... E04D 13/0409 285/348
1,494,234 A 5/1924 Gossett
1,494,882 A * 5/1924 Barger ..... E03C 1/264 4/292
1,503,421 A * 7/1924 Innes ..... E04D 13/0409 285/356
1,509,305 A * 9/1924 Mahon ..... E04D 13/0409 210/163
1,521,883 A * 1/1925 Hess ..... E04D 13/0409 137/433
1,538,924 A * 5/1925 Boosey ..... E04D 13/0409 210/489
1,544,761 A * 7/1925 Kiefer ..... E04D 13/0409 285/47
1,573,067 A * 2/1926 Holland ..... E04D 13/0409 210/463
1,582,646 A * 4/1926 Flesch ..... E04D 13/0409 210/166
1,593,550 A * 7/1926 Holt ..... E04D 13/0409 210/166
1,601,498 A * 9/1926 Hirshstein ..... F16J 13/06 210/163
1,618,679 A * 2/1927 Schifter ..... E03C 1/26 4/292
1,647,414 A 11/1927 Moore
1,651,321 A * 11/1927 Burkelman ..... E04D 13/0409 210/163
1,674,347 A * 6/1928 Silverman ..... E04D 13/0409 210/166
1,690,630 A * 11/1928 Fleming ..... E04D 13/0409 210/166
1,710,304 A * 4/1929 Flynn ..... E04D 13/0409 285/47
1,721,472 A * 7/1929 Rose ..... E04D 13/0409 210/166
1,746,683 A * 2/1930 Schifter ..... E03C 1/262 4/287
1,753,262 A * 4/1930 Cromwell ..... E04D 13/0409 210/166
1,761,257 A * 6/1930 Fleming ..... E04D 13/0409 210/166
1,762,838 A * 6/1930 Shand ..... E04D 13/0409 210/166
1,779,936 A * 10/1930 Hess ..... E04D 13/0409 285/263
1,791,512 A * 2/1931 Schurman ..... E04D 13/0409 210/166
1,809,549 A * 6/1931 Duncan ..... E04D 13/0409 285/200
1,838,092 A * 12/1931 Cromwell ..... E04D 13/0409 285/200
1,862,134 A * 6/1932 Boosey ..... E04D 13/076 52/12
1,903,366 A * 4/1933 Mercier ..... E03C 1/264 4/292
1,918,509 A * 7/1933 Wilcox ..... E04D 13/0409 210/166
1,937,732 A * 12/1933 Tverdak ..... E04D 13/0409 210/162
1,963,300 A * 6/1934 Fleming ..... E03F 5/0407 285/200
1,973,321 A * 9/1934 Schultz ..... E04D 13/0409 210/163
1,988,669 A * 1/1935 Sommerfeld ..... E04D 13/0409 210/166
1,991,772 A * 2/1935 Rieger ..... E04D 13/0409 210/166
1,996,279 A * 4/1935 Dillon ..... E03C 1/264 D23/209
1,999,277 A * 4/1935 Edward ..... E04D 13/0409 285/200
2,019,779 A * 11/1935 Fleming ..... E04D 13/0409 210/164
D101,978 S * 11/1936 Williams ..... D25/19
2,079,269 A * 5/1937 Williams ..... E04D 13/0409 210/163
2,091,927 A * 8/1937 Hirshstein ..... E04D 13/0409 285/356
2,094,434 A * 9/1937 Sherriff ..... E04D 13/0409 285/200
2,119,923 A 6/1938 McIntyre
2,121,220 A * 6/1938 Filkins ..... E04D 13/0409 210/166
2,121,613 A * 6/1938 Schultz ..... E04D 13/0409 210/247
2,131,240 A * 9/1938 Tucker ..... E04D 13/0409 52/12
2,142,343 A * 1/1939 Boosey ..... E04D 13/0409 210/166
2,256,626 A * 9/1941 Rile ..... E04D 13/0409 210/166
2,275,628 A * 3/1942 Hirshstein ..... E04D 13/0409 285/200
2,283,160 A * 5/1942 Boosey ..... E04D 13/0409 210/163
2,283,365 A * 5/1942 Heinkel ..... E04D 13/0409 137/328
2,284,416 A * 5/1942 Gordon ..... E04D 13/0409 210/166
2,311,654 A * 2/1943 Filkins ..... E04D 13/0409 210/166
2,377,373 A * 6/1945 Robertson ..... E04D 13/04 210/463
2,485,547 A * 10/1949 Blau ..... E04D 13/0409 210/354
2,490,075 A 12/1949 Matheis
2,517,195 A 8/1950 Gasper
2,572,208 A * 10/1951 Sievert ..... E04D 13/0409 210/166
2,599,205 A * 6/1952 Schmid ..... E04D 13/0409 210/166
2,618,356 A * 11/1952 Matheis ..... E04D 13/0409 285/356
2,666,493 A * 1/1954 Gordon ..... E04D 13/0409 210/166
2,672,983 A * 3/1954 Blau ..... E04D 13/0409 210/354
2,689,017 A 9/1954 Schmid
2,699,555 A * 1/1955 Green ..... F16K 5/061 137/550
2,701,644 A * 2/1955 Griffiths ..... E04D 13/0409 210/477
2,711,127 A 6/1955 O'Day

(56) References Cited

U.S. PATENT DOCUMENTS 2,740,490 A * 4/1956 Matheis ..... E04D 13/0409 210/166
2,762,448 A * 9/1956 Schmid ..... E04D 13/0409 165/169
2,765,865 A * 10/1956 Schmid ..... E04D 13/0409 210/166
2,807,368 A * 9/1957 Blau ..... E04D 13/0409 52/12
2,837,212 A * 6/1958 Schmid ..... E04D 13/0409 210/247
2,881,921 A * 4/1959 Baker ..... E04D 13/0409 210/166
2,885,689 A * 5/1959 Morris ..... E03C 1/06 210/163
2,888,138 A * 5/1959 Baker ..... E04D 13/0409 210/166
2,898,129 A 8/1959 Sisk
2,970,697 A * 2/1961 Larson ..... E03F 5/14 210/163
2,976,796 A * 3/1961 Anthony ..... F23L 17/02 55/DIG. 20
2,994,433 A * 8/1961 Nils ..... E04D 13/0409 52/12
3,095,219 A * 6/1963 Tutty ..... E04D 13/0409 210/163
3,121,682 A * 2/1964 Alberico ..... E03F 5/0411 210/166
3,212,416 A * 10/1965 Boersma ..... E03F 5/06 210/163
3,245,540 A * 4/1966 Johnson ..... B01D 24/12 210/291
3,321,080 A * 5/1967 Pansini ..... E04H 4/1236 210/167.16
3,357,561 A * 12/1967 Schmid ..... E04D 13/0409 52/12
3,378,858 A * 4/1968 Jacuzzi ..... E04H 4/1236 210/166
3,392,844 A * 7/1968 Decarie ..... E04D 13/0409 210/463
3,447,329 A * 6/1969 Emberson ..... E04D 13/0409 137/356
3,469,698 A * 9/1969 Blendermann ..... E04D 13/0409 52/12
3,469,699 A * 9/1969 Blendermann ..... E04D 13/0409 210/166
3,481,632 A 12/1969 Suess
3,517,813 A * 6/1970 Kunibert ..... E04D 13/0409 210/166
3,529,723 A * 9/1970 Hagedorn ..... E04D 13/0409 210/163
3,667,611 A * 6/1972 Pansini ..... E04H 4/1236 210/473
3,722,532 A * 3/1973 Ebeling ..... E04D 13/0409 137/357
3,757,812 A * 9/1973 Duncan ..... F04D 29/586 137/142
3,774,765 A 11/1973 Kane et al.
3,811,644 A 5/1974 Arnault
3,884,809 A * 5/1975 Logsdon ..... E04D 13/0409 210/163
3,893,919 A * 7/1975 Flegel ..... E04D 13/0409 210/166
3,894,302 A 7/1975 Lasater
3,909,412 A * 9/1975 Patry ..... E04D 13/0409 210/166
3,932,281 A * 1/1976 Pansini ..... E04H 4/1636 210/167.17
3,935,878 A * 2/1976 Ostevik ..... E04D 13/0409 52/12
D244,170 S * 5/1977 Pearce ..... D7/667
4,035,297 A * 7/1977 Aldridge ..... E04D 13/0409 251/339
4,073,018 A 2/1978 Arrowood
4,107,929 A * 8/1978 Ebeling ..... E04D 13/0409 52/12
4,112,691 A * 9/1978 Ebeling ..... E04D 13/0409 52/12
D249,955 S * 10/1978 Vogelsang ..... D23/261
4,134,162 A * 1/1979 Sharland ..... E03C 1/264 4/293
4,170,047 A * 10/1979 Corsette ..... E04H 4/1236 4/293
D255,596 S 6/1980 Johnson
4,216,790 A * 8/1980 Stoltz ..... E04D 13/0767 52/12
D256,948 S * 9/1980 Boersma ..... D23/308
4,230,346 A * 10/1980 Gobel ..... E04D 13/0409 4/290
4,246,664 A 1/1981 Reynolds
4,285,812 A * 8/1981 Stoltz ..... E04D 13/0409 52/12
4,400,272 A * 8/1983 Logsdon ..... E04D 13/0409 210/166
4,437,687 A * 3/1984 Wilson ..... E04F 17/02 285/44
4,460,462 A * 7/1984 Arneson ..... E04H 4/1236 210/167.16
4,471,497 A * 9/1984 Riutort ..... E03C 1/264 4/286
4,487,690 A * 12/1984 Logsdon ..... E04D 13/0409 405/36
4,505,499 A * 3/1985 Uglow ..... E04D 13/0409 285/346
4,505,814 A * 3/1985 Marshall ..... E04D 13/0409 404/26
4,525,273 A * 6/1985 Logsdon ..... E04D 13/0409 210/166
4,652,365 A * 3/1987 Ebeling ..... E04D 13/0409 52/12
4,658,449 A * 4/1987 Martin ..... E04H 4/1236 210/162
4,683,685 A * 8/1987 Ebeling ..... E04D 13/0409 52/12
4,759,163 A * 7/1988 Mason ..... E04D 13/0409 52/58
4,799,713 A * 1/1989 Uglow ..... E04D 13/0409 210/163
4,839,927 A 6/1989 Watanabe
4,943,100 A 7/1990 Emberson
4,961,848 A * 10/1990 Logsdon ..... E04D 13/0409 210/166
4,984,308 A 1/1991 Handal
4,984,309 A 1/1991 Lowry
D318,101 S * 7/1991 Rodgers ..... D23/259
D319,295 S * 8/1991 Ohaus ..... D23/261
5,141,633 A * 8/1992 Walczak ..... E04D 13/0409 210/232
5,144,782 A * 9/1992 Paquette ..... E04D 13/1687 52/14
5,165,119 A * 11/1992 Yamato ..... E03D 9/032 422/264
5,174,128 A 12/1992 Bourne et al.
5,234,582 A * 8/1993 Savoie ..... E04D 13/0409 52/12
D341,413 S * 11/1993 Nichols ..... D23/261
D343,228 S * 1/1994 Colin ..... D23/261
5,297,895 A * 3/1994 Johnson ..... E02B 11/00 405/74
D348,924 S * 7/1994 Merrett ..... D23/261
5,372,715 A 12/1994 Maggard et al.
5,378,356 A * 1/1995 Logsdon ..... E04D 13/0409 210/166
5,394,657 A * 3/1995 Peterson ..... F04F 5/54 52/302.1
5,458,769 A 10/1995 Johannessen
5,469,670 A * 11/1995 Thaler ..... E04D 13/0409 52/12

(56) References Cited

U.S. PATENT DOCUMENTS 5,522,197 A * 6/1996 Ebeling ..... E04D 13/0409 52/302.1
5,526,613 A * 6/1996 Simeone, Jr. ..... E04D 13/0409 52/302.1
5,531,543 A * 7/1996 Johnsen ..... E04D 13/0409 52/11
5,575,903 A * 11/1996 Kato ..... E04D 13/0409 210/170.03
5,615,526 A * 4/1997 Palmer ..... E04D 13/0431 52/302.1
5,618,416 A * 4/1997 Haefner ..... E04D 13/0409 210/166
5,650,065 A * 7/1997 Sewell ..... E03F 5/16 52/12
5,689,928 A * 11/1997 Rasksen ..... E04D 13/0409 52/302.1
5,702,596 A 12/1997 Juple et al.
5,722,791 A * 3/1998 Dallmer ..... E04D 13/0409 405/36
5,724,684 A * 3/1998 Paar ..... E03C 1/26 4/286
5,724,777 A * 3/1998 Hubbard ..... E04D 13/0409 52/302.1
5,733,444 A * 3/1998 Johnson ..... E03F 5/0404 210/232
5,734,999 A * 4/1998 Nicholas ..... E04H 4/1236 4/496
5,735,091 A * 4/1998 Hawkins ..... E04D 13/0409 52/302.1
5,749,190 A 5/1998 Williams
5,799,339 A * 9/1998 Perry ..... A47K 1/14 4/286
5,800,092 A 9/1998 Nill et al.
5,843,306 A * 12/1998 Singleton ..... B01D 29/15 210/170.03
5,902,008 A 5/1999 Butsuen et al.
5,926,865 A * 7/1999 Witinski ..... E04H 4/12 4/492
5,966,884 A * 10/1999 Uglow ..... E04D 13/0409 52/302.1
6,004,457 A * 12/1999 Singleton ..... E03F 5/0401 210/170.03
6,041,556 A 3/2000 Keller
6,056,014 A 5/2000 Kojima et al.
6,141,916 A * 11/2000 Shackelford ..... E03F 3/046 52/12
6,163,896 A * 12/2000 Lee ..... E03C 1/264 4/286
6,165,357 A * 12/2000 Cormier ..... E04D 13/0409 52/12
6,168,208 B1 * 1/2001 Thaler ..... E04D 13/0409 285/110
D439,957 S * 4/2001 Barnett ..... D23/261
6,209,572 B1 4/2001 Wicklund
6,209,586 B1 * 4/2001 Wright ..... E04H 4/1236 4/507
6,261,445 B1 * 7/2001 Singleton ..... E03F 5/04 210/170.03
D446,844 S * 8/2001 Claussen ..... D23/261
6,295,661 B1 * 10/2001 Bromley ..... F16K 17/36 251/295
6,318,397 B1 * 11/2001 Huber ..... F16K 15/16 137/856
6,340,035 B2 * 1/2002 Wright ..... E04H 4/1236 4/507
6,360,379 B1 * 3/2002 Lane ..... E04H 4/1236 210/163
6,360,779 B1 * 3/2002 Wagner ..... F16L 55/1141 220/802
6,393,631 B2 * 5/2002 Schroader ..... E04H 4/1236 4/292
6,397,408 B1 * 6/2002 Veloskey ..... E04H 4/1236 4/292
6,408,452 B1 * 6/2002 Bromley ..... E04H 4/1236 251/295
D460,810 S * 7/2002 Sommerhein ..... D23/261
6,416,674 B1 * 7/2002 Singleton ..... E03F 5/105 210/170.03
6,428,693 B2 * 8/2002 Singleton ..... E03F 5/0404 210/170.03
6,442,774 B2 * 9/2002 Wilson ..... E04H 4/1236 4/292
D466,198 S * 11/2002 Mullings ..... D23/261
6,588,029 B2 * 7/2003 Mullings ..... E04H 4/1236 4/286
6,594,966 B2 * 7/2003 Froeter ..... E04D 13/0409 52/302.1
6,609,257 B1 * 8/2003 O'Geary ..... E03C 1/264 4/290
6,615,417 B1 * 9/2003 Newhard ..... E04H 4/1236 4/292
6,631,588 B1 * 10/2003 Distler ..... E04D 13/0409 52/302.1
6,647,682 B2 * 11/2003 Bishop ..... E04D 13/0409 52/302.1
6,810,537 B1 * 11/2004 Barnes ..... E04H 4/1236 4/507
6,833,067 B2 * 12/2004 Dresmann ..... E04D 13/0409 52/302.1
6,953,208 B2 * 10/2005 Warnecke ..... E04F 17/00 52/196
7,005,061 B1 * 2/2006 Downs ..... E03F 1/00 210/474
7,010,889 B1 3/2006 Renfro
7,011,746 B2 * 3/2006 Bockmann ..... E04D 13/0409 52/302.1
7,108,783 B2 * 9/2006 Glazik ..... E03F 5/0404 210/170.03
7,178,179 B2 * 2/2007 Barnes ..... E03C 1/26 4/292
D550,819 S * 9/2007 Seehoff ..... D23/261
7,300,573 B1 * 11/2007 Trangsrud ..... E03F 1/00 210/474
D563,529 S * 3/2008 Labonte ..... D23/261
7,407,574 B2 * 8/2008 Robinson ..... E04D 13/0767 52/12
7,415,802 B2 * 8/2008 Froeter ..... E04D 13/0409 52/302.1
D576,257 S * 9/2008 Rattenbury ..... D23/260
D578,619 S * 10/2008 Rattenbury ..... D23/261
D598,523 S * 8/2009 McAlpine ..... D23/268
D598,987 S * 8/2009 McAlpine ..... D23/268
7,591,111 B2 * 9/2009 Froeter ..... E04D 13/0409 52/302.1
7,614,198 B1 * 11/2009 Piskula ..... E04D 13/0409 52/302.1
D606,174 S * 12/2009 Martin ..... D23/261
7,658,043 B2 2/2010 Wroblewski
D613,829 S * 4/2010 Griffin ..... D23/260
7,718,055 B2 * 5/2010 Iou ..... E04D 13/0409 52/302.1
7,739,757 B2 * 6/2010 Witt ..... E03F 5/0408 4/612
D621,009 S * 8/2010 Mjelde ..... D23/261
7,784,242 B2 * 8/2010 Warnecke ..... E04D 13/0409 52/302.1
D629,875 S * 12/2010 Sears ..... D23/261
7,854,838 B2 * 12/2010 Martin ..... E02B 5/085 210/170.03
7,946,087 B1 * 5/2011 Seitzinger ..... E04F 17/00 52/302.1
7,997,038 B2 8/2011 Warnecke et al.
8,006,449 B2 * 8/2011 Warnecke ..... E04D 13/0409 52/302.1
8,146,308 B2 4/2012 Warnecke et al.
8,246,430 B1 * 8/2012 Paynton ..... F23J 13/08 454/44

(56) References Cited

U.S. PATENT DOCUMENTS

D670,363 S * 11/2012 Yousufzai ..... D23/261
8,347,424 B2 1/2013 Wroblewski et al.
8,496,822 B2 * 7/2013 Schoell ..... E04D 13/0409 52/12
8,557,108 B2 * 10/2013 Rennels ..... E03C 1/264 210/163
8,557,109 B1 * 10/2013 Sutherland ..... E03F 5/0404 210/163
8,595,992 B2 * 12/2013 May ..... E04D 13/00 52/302.1
8,628,657 B1 * 1/2014 Robillard ..... B01D 35/02 52/302.1
8,679,328 B2 * 3/2014 Hebert ..... E03F 5/0404 210/163
8,834,714 B2 * 9/2014 Chien ..... E03F 1/00 210/166
8,850,633 B2 10/2014 Erlebach
8,869,319 B2 * 10/2014 Griffin ..... E04H 4/14 4/507
8,881,490 B2 11/2014 Wroblewski et al.
8,950,123 B1 * 2/2015 Chai ..... E04D 13/0409 52/12
8,951,413 B2 * 2/2015 Lawson ..... E04H 4/1218 210/167.16
8,973,325 B1 * 3/2015 Chai ..... E04D 13/0409 137/151
D726,886 S * 4/2015 Sutherland ..... D23/261
9,015,870 B2 * 4/2015 Ball ..... E03C 1/22 4/286
9,015,876 B2 * 4/2015 Ball ..... E03C 1/22 285/46
9,057,519 B1 * 6/2015 Paynton ..... F23L 17/12
9,103,107 B2 8/2015 Wroblewski et al.
9,139,365 B2 * 9/2015 Andersen ..... E04D 13/0409
D743,509 S * 11/2015 Traub ..... D23/261
9,334,618 B1 * 5/2016 Dodd ..... E03F 1/002
9,340,988 B2 * 5/2016 Lyristakis ..... E04H 4/06
9,422,709 B2 8/2016 Wroblewski et al.
9,428,900 B2 8/2016 Wroblewski et al.
9,435,435 B2 * 9/2016 Gavin ..... F16J 13/065
9,453,331 B1 9/2016 Buffington
9,458,616 B2 10/2016 Whiteside
9,518,389 B1 * 12/2016 McDanal ..... E04D 13/0409
9,573,086 B2 * 2/2017 Corder ..... B01D 35/02
D781,401 S * 3/2017 Yan ..... D23/261
9,637,928 B2 * 5/2017 Liptak ..... E04D 13/0409
9,643,113 B2 * 5/2017 Farmer ..... E03C 1/264
9,719,240 B1 * 8/2017 Montague ..... E03F 5/041
D803,992 S * 11/2017 Huber ..... E04D 13/0409 D23/261
9,920,533 B2 * 3/2018 Johnsen ..... E04D 13/0409
9,945,125 B2 * 4/2018 Huber ..... E04D 13/0409
D816,812 S * 5/2018 Huber ..... E03F 5/06 D23/261
D832,406 S * 10/2018 Huber ..... E04D 13/0409 D23/261
10,113,303 B2 * 10/2018 Mardian ..... E03F 5/06
10,167,622 B2 1/2019 Brooks et al.
10,196,806 B2 * 2/2019 Priester ..... E03F 5/0407
10,428,529 B1 * 10/2019 Tanghongs ..... E04D 13/0643
10,465,370 B2 * 11/2019 Donnelly ..... F16L 5/027
10,487,492 B2 * 11/2019 Boersma ..... E03C 1/26
10,519,666 B2 * 12/2019 Huber ..... E03F 5/06
D881,338 S * 4/2020 Chen ..... D23/209
10,676,930 B2 * 6/2020 West ..... E04D 13/0409
10,711,447 B2 7/2020 Say et al.
10,711,463 B2 * 7/2020 Huber ..... E03F 5/06
10,760,275 B2 * 9/2020 Leslie ..... E04D 13/0409
10,822,785 B1 * 11/2020 Berry ..... E03F 5/0404
10,907,356 B2 * 2/2021 Mechler ..... E03F 5/06
D911,861 S * 3/2021 Gadonniex ..... D10/106.5
10,961,714 B2 * 3/2021 Herrero-Smith .... E04D 13/0409
11,008,748 B1 * 5/2021 Hodge, Jr. ..... E03F 5/06
11,047,126 B1 6/2021 Whiteside
11,060,292 B2 * 7/2021 Leslie ..... E04D 13/0481
11,286,670 B2 * 3/2022 Huber ..... E04D 13/0409
11,293,171 B2 * 4/2022 Berry ..... E04D 13/0409
11,441,305 B1 * 9/2022 Alhazza ..... E04D 13/0409
11,447,943 B2 * 9/2022 Donnelly ..... F16L 27/1275
11,634,910 B2 * 4/2023 Leslie ..... E04D 13/0409 52/506.05
11,643,819 B2 * 5/2023 Huber ..... E04D 13/0431 210/166
11,708,690 B2 * 7/2023 Singleton ..... E03F 5/14 210/166
11,920,350 B2 * 3/2024 Iftissen ..... E04D 13/0409
2001/0023842 A1 * 9/2001 Singleton ..... E03F 5/0404 210/170.03
2001/0042266 A1 * 11/2001 Schroader ..... E04H 4/1236 210/163
2002/0100224 A1 * 8/2002 Martin ..... E04D 13/0409 52/39
2003/0037498 A1 * 2/2003 Bishop ..... E04D 13/0409 52/302.1
2003/0084631 A1 * 5/2003 Froeter ..... E04F 17/00 52/302.1
2003/0141231 A1 7/2003 Rattenbury et al.
2003/0159384 A1 * 8/2003 Warnecke ..... E04F 17/00 52/302.1
2003/0201217 A1 * 10/2003 Dresmann ..... E04D 13/0409 210/163
2004/0182763 A1 * 9/2004 Bockmann ..... E04D 13/0409 210/164
2005/0178073 A1 * 8/2005 Froeter ..... E04D 13/0409 52/12
2005/0203468 A1 * 9/2005 Warnecke ..... E04F 17/00 604/317
2006/0011599 A1 * 1/2006 Graves ..... E04D 13/0409 219/213
2006/0053544 A1 * 3/2006 Hui ..... E04H 4/1236 4/507
2006/0059813 A1 * 3/2006 Froeter ..... F24F 7/02 52/302.1
2006/0124519 A1 * 6/2006 Glazik ..... E03F 1/00 405/36
2006/0242913 A1 * 11/2006 Zhou ..... E04D 13/0409 52/19
2007/0137126 A1 6/2007 Sommerhein
2007/0205144 A1 * 9/2007 Robinson ..... E04D 13/0767 210/163
2007/0262030 A1 * 11/2007 Meng Fei ..... E03C 1/264 210/474
2008/0222800 A1 * 9/2008 Warnecke ..... E04D 13/0409 4/695
2008/0245421 A1 * 10/2008 Iou ..... E04D 13/0409 210/415
2009/0013620 A1 * 1/2009 West ..... E04D 13/1476 52/741.1
2009/0049594 A1 * 2/2009 Landsberger ..... E03C 1/264 4/292
2009/0065071 A1 * 3/2009 Vahlbrauk ..... E04D 13/0409 137/357
2010/0025312 A1 * 2/2010 Martin ..... E02B 5/085 210/170.03
2010/0213140 A1 * 8/2010 Won ..... E03C 1/264 210/163
2010/0257791 A1 * 10/2010 May ..... E04D 13/0409 52/12
2011/0030284 A1 * 2/2011 May ..... E04D 13/00 52/12
2011/0031174 A1 * 2/2011 Liang ..... E03F 5/0407 210/166
2011/0049036 A1 * 3/2011 Schoell ..... E04D 13/0409 210/238
2011/0209279 A1 * 9/2011 Ball ..... E03C 1/22 4/292
2011/0314748 A1 12/2011 Smith
2012/0222996 A1 * 9/2012 Rennels ..... E03C 1/264 210/163

(56) References Cited

U.S. PATENT DOCUMENTS

2013/0264256 A1* 10/2013 Hebert ..... E03F 5/0404 210/163
2013/0333304 A1 12/2013 Smith
2014/0069854 A1* 3/2014 Sutherland ..... E03F 5/0409 210/163
2014/0158593 A1* 6/2014 Chien ..... E03F 1/00 210/166
2014/0265158 A1* 9/2014 Liptak ..... E04D 13/0409 277/616
2015/0047267 A1* 2/2015 May ..... E04D 13/0409 52/12
2015/0115596 A1* 4/2015 Donnelly ..... F16L 5/12 285/42
2015/0151915 A1* 6/2015 Andersen ..... E04D 13/0409 29/890.14
2015/0233628 A1* 8/2015 Farmer ..... B01D 35/02 210/166
2016/0153195 A1* 6/2016 Johnsen ..... E04D 13/0409 52/302.1
2016/0230393 A1* 8/2016 Huber ..... E04D 13/0409
2016/0333586 A1 11/2016 King
2017/0247886 A1* 8/2017 West ..... E04D 13/0409
2018/0080484 A1* 3/2018 Venkatesan ..... E04D 13/0767
2018/0112407 A1* 4/2018 Herrero-Smith .... E04D 13/0767
2018/0195287 A1* 7/2018 Huber ..... E04D 13/0409
2018/0195288 A1* 7/2018 Huber ..... E04D 13/0409
2019/0078311 A1 3/2019 Paivinen
2019/0383019 A1* 12/2019 Hetzler ..... E04D 13/0409
2019/0383020 A1* 12/2019 Mechler ..... E04D 13/0409
2020/0181913 A1* 6/2020 Leslie ..... E04D 13/0409
2020/0284037 A1* 9/2020 Leslie ..... E04D 13/0481
2020/0340230 A1 10/2020 Say et al.
2020/0378126 A1* 12/2020 Huber ..... E04D 13/0431
2021/0047817 A1* 2/2021 Berry ..... E03C 1/264
2021/0238839 A1 8/2021 Say et al.
2021/0317666 A1* 10/2021 Majocka ..... E04D 13/0409
2021/0348390 A1* 11/2021 Iftissen ..... E04D 13/0409
2021/0396015 A1* 12/2021 Leslie ..... E04D 13/1606
2022/0025653 A1* 1/2022 Huber ..... E04D 13/0409
2022/0120086 A1* 4/2022 Majocka ..... E04D 13/0409
2022/0145635 A1* 5/2022 Rasmussen ..... G08B 25/10
2022/0316213 A1* 10/2022 Huber ..... E04D 13/0431
2022/0316214 A1* 10/2022 Williams, II ..... G01F 23/0007
2022/0316215 A1* 10/2022 Iftissen ..... E04D 13/0409
2023/0139368 A1* 5/2023 Henderson ..... E04D 11/007 52/126.6
2023/0228087 A1* 7/2023 Majocka ..... E04D 13/0409 285/42
2023/0257996 A1* 8/2023 Leslie ..... E04D 13/1693 52/506.05
2023/0272620 A1* 8/2023 Rasmussen ..... E04D 13/0409
2024/0058844 A1* 2/2024 Sturgill ..... A46B 15/0055

OTHER PUBLICATIONS

RJ Smith Catalogue 2008 18 pages (Year: 2008).*
Froet Drain 12 pages Jan. 1, 2019 (Year: 2019).*
Zurn 100DP Froet Drain Specification Sheet, 1 page, Jan. 20, 2019. (Year: 2019).*
Zurn 100C Froet Drain Specification Sheet, 1 page, Nov. 18, 2021. (Year: 2021).*
Zurn FloForce Improper Roof Membrane Installation, 1 page, May 5, 2022. (Year: 2022).*
Zurn Z100 FloForce Roof Drain General Installation Instructions, 1 page, May 5, 2022 (Year: 2022).*
Zurn Z100 FloForce Specification Sheets, 6 pages, Aug. 8, 2023. (Year: 2023).*
Zurn Drain Catalog—SD 112 Customer Guide, Distributed by Best Materials LLC, 201 Total Pages (Not consecutively numbered), Downloaded: Mar. 5, 2024. (Year: 2024).*
Zurn Z100 FloForce Design Guide, 9 pages, Undated, Downloaded: Mar. 5, 2024. (Year: 2024).*
Olympic Manufacturing Group (OMG, Inc.), Internet; Olyfast Accessories, Olyflow Drain Systems, FlowControl, OverFlow, and QuickFlow, website: http://www.olyfast.com, viewed Feb. 28, 2005; (2 Pages).
Canadian Office Action dated Mar. 27, 2024 for Canadian Application No. 3113904.
Manual SK-2 Specifications and Roughing Dimensions, Josam Plumbing Drainage Product, Josam Manufacturing Co., U.S., 1959, 4 pages (cover pages and p. 99).†
Josam Plumbing Drainage Guide—Six, Josam Manufacturing Co., U.S., Oct. 15, 1980, 3 pages (cover pages and p. 73).†
Josam Plumbing Drainage Guide—Seven, Josam Manufacturing Co., U.S., Jun. 1, 1984, 4 pages (cover pages and p. 77).†
Josam Plumbing Drainage Guide—Five, Josam Manufacturing Co., U.S., Mar. 28, 1975, 4 pages (cover pages and p. 86).†

* cited by examiner
† cited by third party

Drain Outlet Size - 2"

| Flow Data | |
|---|---|
| Avg. Tank Level (in.) | Avg. Flow Rate (GPM) |
| 1.00 | 85.60 |
| 1.28 | 141.96 |
| 1.46 | 147.43 |
| | |
| | |
| | |

Drain Outlet Size - 3"

| Flow Data | |
|---|---|
| Avg. Tank Level (in.) | Avg. Flow Rate (GPM) |
| 1.00 | 81.33 |
| 2.00 | 320.28 |
| 3.03 | 349.76 |
| 4.00 | 352.40 |
| 5.03 | 356.12 |
| 6.00 | 359.25 |

Drain Outlet Size - 4"

| Flow Data | |
|---|---|
| Avg. Tank Level (in.) | Avg. Flow Rate (GPM) |
| 1.00 | 81.68 |
| 2.01 | 314.14 |
| 3.01 | 580.74 |
| 3.99 | 618.29 |
| 5.00 | 624.89 |
| 6.02 | 630.21 |

Drain Outlet Size - 6"

| Flow Data | |
|---|---|
| Avg. Tank Level (in.) | Avg. Flow Rate (GPM) |
| 1.01 | 102.46 |
| 2.00 | 397.65 |
| 3.00 | 757.11 |
| 4.01 | 1164.82 |
| 5.03 | 1489.41 |
| 6.03 | 1505.44 |

Drain Outlet Size - 8"

| Flow Data | |
|---|---|
| Avg. Tank Level (in.) | Avg. Flow Rate (GPM) |
| 1.00 | 122.23 |
| 2.01 | 440.68 |
| 3.00 | 829.67 |
| 4.00 | 1289.54 |
| 5.02 | 1818.32 |
| 5.90 | 2376.50 |

FIG. 35

DOMED ROOF DRAIN STRAINER ASSEMBLY

CROSS-REFERENCE TO RELATED APPLICATIONS

The present application claims priority to U.S. Provisional Patent Application No. 63/009,894, filed Apr. 14, 2020. The entire contents of which are hereby incorporated by reference.

FIELD

The embodiments described herein relate to a roof drain, and more particularly, to a roof drain having improved drainage and flow characteristics.

BACKGROUND

Commercial buildings are typically constructed with flat or near flat roofs. Because these building do not have much of a pitch, the collection of water on the roof surface from rain or melting snow can present serious structural loads that could result in collapse. To avoid this possibility, most commercial and industrial building standards require that roofs of this type include drains positioned at locations that ensure the water accumulated thereon can be removed in a timely manner.

SUMMARY

In one embodiment, a roof drain including a base defining a channel and an axis, a gravel guard coupled to the base and including a plurality of teeth, where the gravel guard defines a plurality of gullets between the teeth, and a dome coupled to the base, where the dome includes a plurality of ribs, where the ribs define a plurality of gaps therebetween, and where each gap is radially aligned with a corresponding gullet.

In another embodiment, a roof drain including a base defining an axis, the base having a throat portion and a flange portion extending radially outwardly from the throat portion, where the throat portion at least partially defines a channel therethrough having an outlet, and where the flange portion includes an outer edge and a top plane, a gravel guard coupled to the base and including a plurality of teeth, where the gravel guard defines a plurality of gullets, and where at least a portion of each gullet is positioned axially below the top plane, and a dome coupled to the base.

In another embodiment, a roof drain including a base at least partially defining a channel therethrough, where the channel includes an inlet and an outlet defining an outlet diameter, and where the base defines a top plane, a gravel guard coupled to the base and including a plurality of teeth and a plurality of gullets positioned between adjacent teeth, and a dome coupled to the base, where the roof drain is configured to flow between 75 GPM and 150 GPM through the channel at 1" of head pressure measured relative to the top plane.

BRIEF DESCRIPTION OF THE DRAWINGS

FIGS. 35-36 illustrate flow data generally corresponding to an embodiment of the roof drain.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

Figure 27:
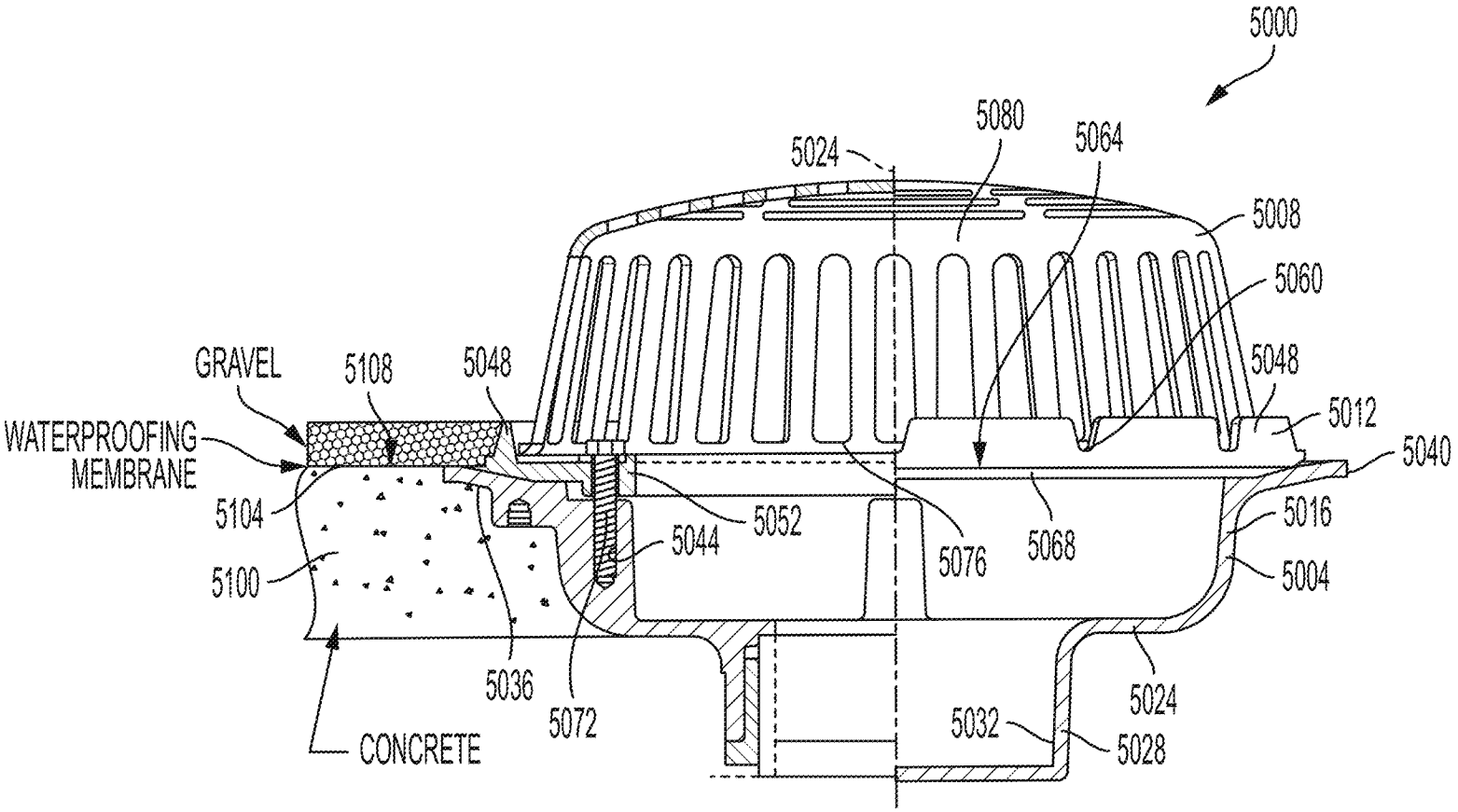
FIG. 27 PRIOR ART
FIG. 27 illustrates a prior art embodiment of a roof drain installed on a roof.

FIG. 27 illustrates a prior art embodiment of a roof drain 5000 mounted to a roof 5100 with a roof membrane 5104 to produce a finished surface 5108. The roof drain 5000 includes a base 5004, a dome 5008, and a gravel guard 5012. As is shown in FIG. 27, the base 5004 is substantially "bowl" shaped having a first or vertically oriented wall 5016 (e.g., parallel to an axis 5024) along the perimeter thereof and a second or horizontally oriented wall 5020 (e.g., perpendicular to the axis 2024) at the downstream end thereof). Together, the first and second walls 2016, 5020 form a substantially "concave" shape. The second wall 5016 also includes an outlet cylinder 5028 extending axially from the second wall 5020 to produce an outlet 5032. The base 5004 also includes a flange 5036 extending radially outwardly from the first wall 5016 to produce an outer end 5040.

The base 5004 also includes a series of threaded apertures 5044 positioned at least partially within the "bowl" and spaced radially inwardly from the teeth 5048 of the gravel guard 5012.

The gravel guard 5012 of the roof drain 5000 rests against the flange portion 2036 of the base 5004 and includes a series of teeth 5048, and a plurality of bolt apertures 5052 spaced radially inwardly from the teeth 5048. The gravel guard 5012 also includes a plurality of gullets 5060 positioned between the teeth 5048 that are positioned vertically above the finished surface 5108 of the adjacent roof 5100 and vertically above the outer edge 5040 of the base 5004. The gullets 5060 are also positioned above the top surface 5064 of the gravel guard body 5068. When assembled, the gravel guard 5012 is secured to the base 5004 with fasteners 5072 extending through the bolt apertures 5052 and threaded into the threaded apertures 5044 of the base 5004.

As shown in FIG. 27, the dome 5008 of the drain 5000 is attached to the base 5004 via the gravel guard 5012 (e.g., it rests on the gravel guard 5012). The dome 5008 has a completely enclosed bottom edge 5076 and a completely enclosed transition area 5080.

FIGS. 1-5 illustrate a roof drain 10 configured to be installed on the roof 14 of a building. The roof drain 10 includes a base 18 at least partially defining a channel 38, a cage or dome 26, and a gravel guard or gravel ring 30. When installed, the channel 38 of the drain 10 is placed in fluid communication with a plumbing system 34 (e.g., a network of conduits to reroute the rainwater off of the roof) of the corresponding building such that water accumulating on the roof 14 is collected by the drain 10 and directed into the plumbing system 34 via the channel 38. More specifically, the roof drain 10 is configured to intake rain water and discharge the water into the plumbing system 34 producing a gravitational flow therein. Generally speaking, a gravitational flow system operates using the force of gravity to generate the flow therein typically through pitched piping and the like. Gravitational flow systems generally permit both air and water to enter the plumbing system 34. A gravitational system is different than a siphonic system which is configured to operate with the piping completely charged with water so that siphonic forces are utilized to encourage the flow of fluids therethrough.

The base 18 of the drain 10 is substantially "funnel" shaped defining the channel 38 through which rainwater may be directed into the plumbing system 34 of the building. More specifically, when rainwater collects on the roof 14, the water flows into the inlet 40 of the channel 38 where it is directed into the plumbing or drain system 34 via the outlet 22 thereof. In the illustrated embodiment, the base 18 includes a throat portion 42 at least partially defining the channel 38, and a flange portion 46 extending radially outwardly from the throat portion 42. Together, the throat portion 42 and flange portion 46 define a central axis 50. While the illustrated base 18 is cast as a single piece of material, it is to be understood that in alternative embodiments, the base 18 may be formed as multiple pieces coupled together.

Figure 7:
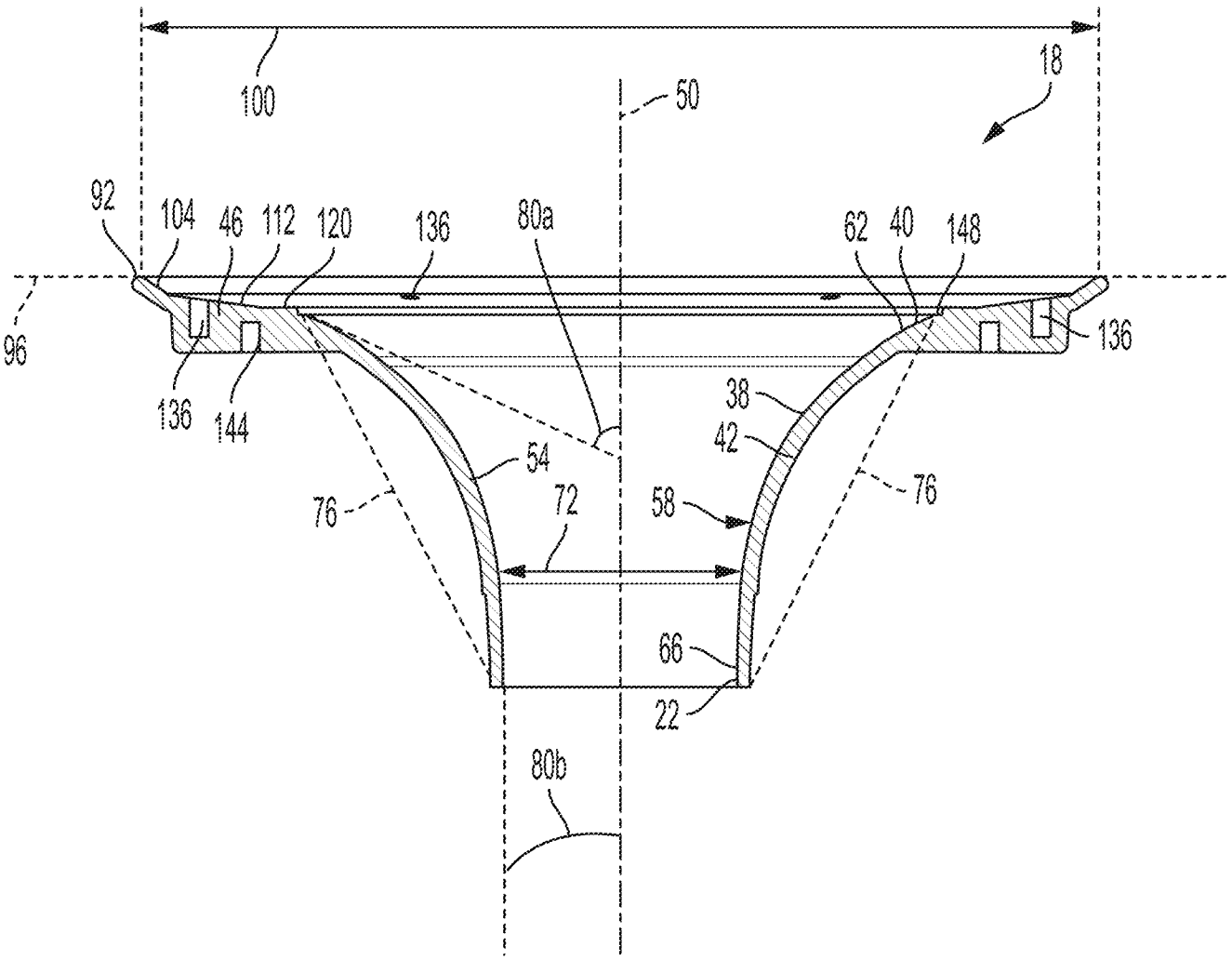
FIG. 7 is a section view taken along line 7-7 of FIG. 6.

The throat portion 42 of the base 18 is formed from a substantially annular wall 54 having an inner surface 58, a first end 62 generally corresponding with the inlet 40 of the channel 38, and a second end 66 opposite the first end 62 that generally corresponds with and forms the outlet 22 of the channel 38. The inner surface 58 is shaped such that the inner diameter 72 of the inner surface 58 continuously and smoothly decreases as it extends axially away from the first end 62 and toward the second end 66. More specifically, the cross-sectional shape of the inner surface 58, taken along the axis 50, forms a substantially convex shape over its entire axial length (see FIG. 7). The throat portion 42 also defines a frusto-conical-datum surface 76 generally defined as a frusto-conically-shaped surface that is co-axial with the axis 50 and extends from the first end 62 to the second end 66. In such embodiments, the inner surface 58 is shaped such that it is always positioned radially inside the frusto-conical datum surface 76.

Figure 4:
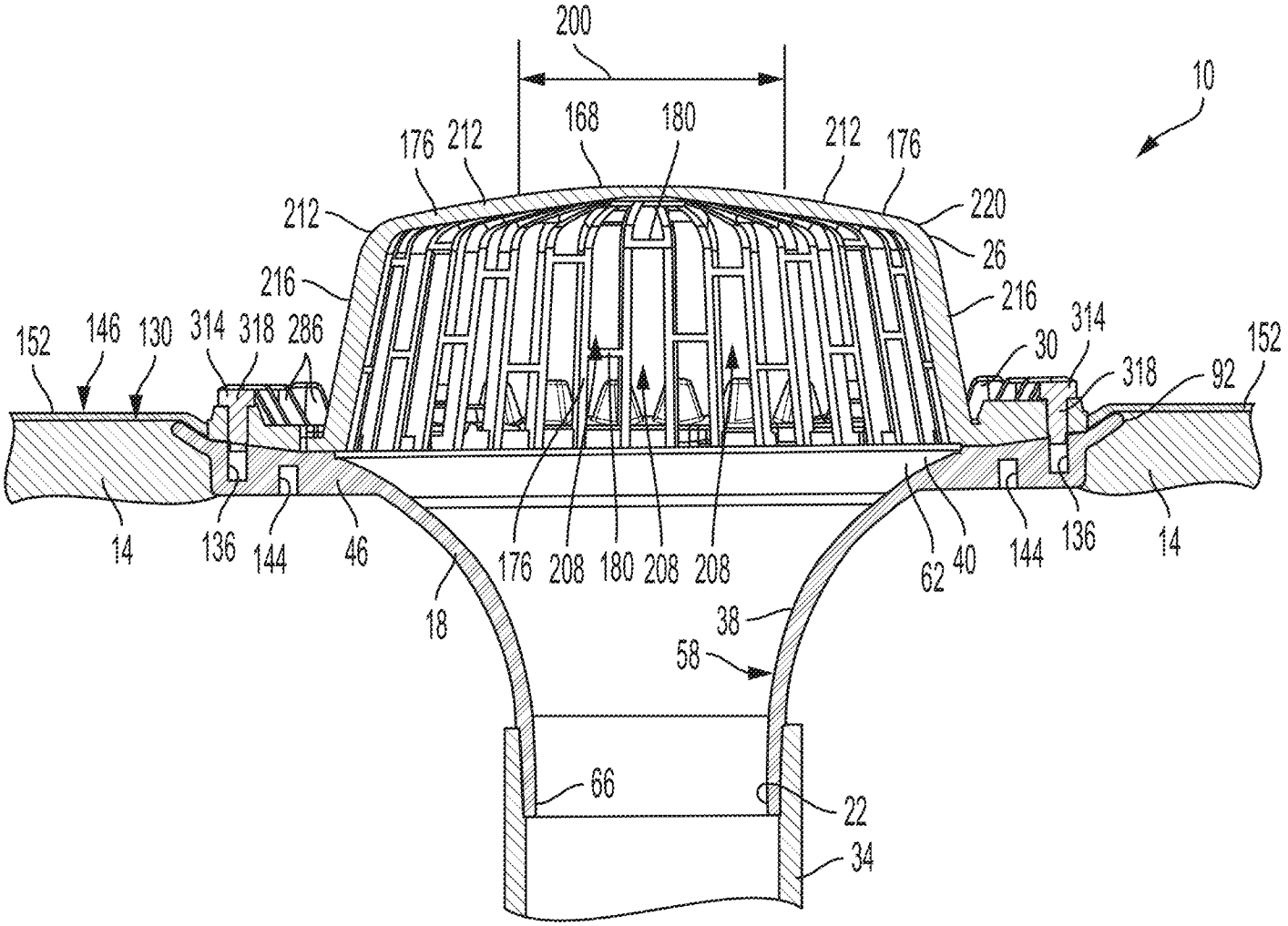
FIG. 4 is a section view taken along line 4-4 of FIG. 3.

The inner surface 58 of the throat portion 42 forms a first surface angle 80*a* relative to the axis 50 at the first end 62 thereof and a second surface angle 80*b* relative to the axis 50 at the second end 66 thereof (see FIG. 4). In the illustrated embodiment, the first surface angle 80*a* is greater than the second surface angle 80*b*. Furthermore, the inner surface 58 smoothly transitions from the first surface angle 80*a* to the second surface angle 80*b* while always decreasing in value. In the illustrated embodiment, the first surface angle 80*a* is between approximately 40 and 70 degrees while the second surface angle 80*b* is between approximately 0 and 15 degrees. In other embodiments, the first angle 80*a* is between approximately 50 and 65 degrees. In still other embodiments, the first angle 80*a* is approximately one of 51 degrees, 52 degrees, 59 degrees, 60 degrees, and 62 degrees. Other embodiments, the second angle 80*b* may be between approximately 0 and 5 degrees. In still other embodiments, the second angle 80*b* may be approximately 3 degrees. In still other embodiments, the first angle 80*a* and second angle 80*b* may vary depending on the diameter of the outlet 22.

Figure 22:
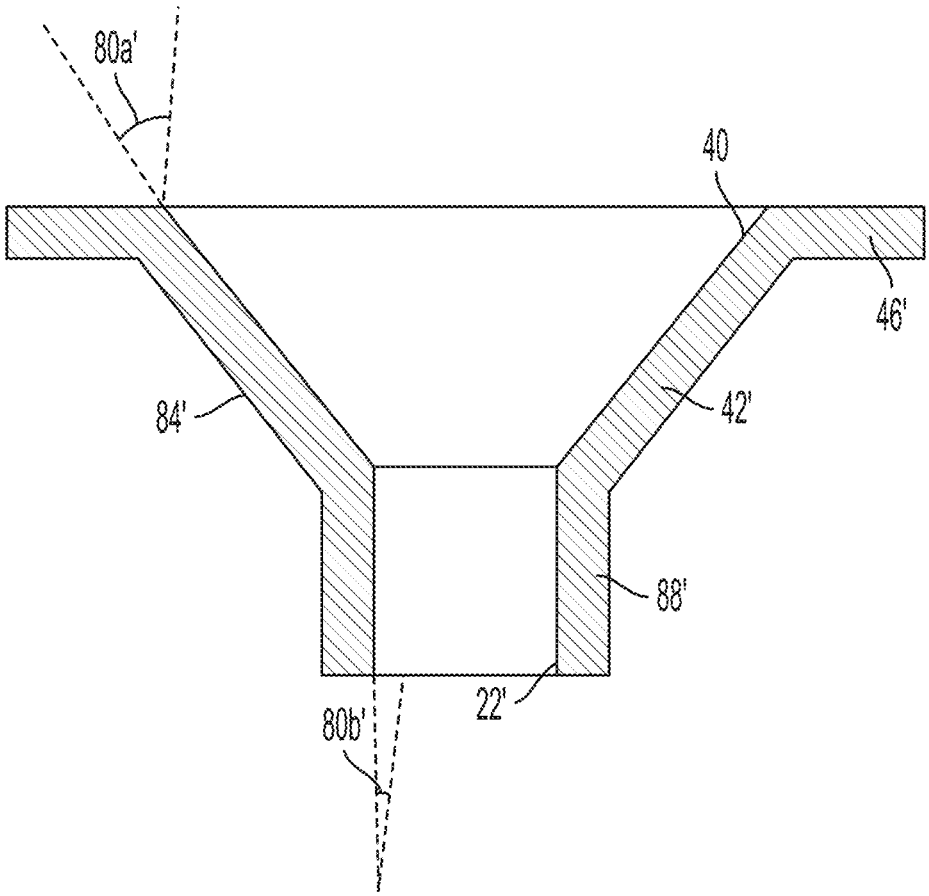
FIG. 22 is a perspective view of another embodiment of a base.

While the illustrated inner surface 58 provides a smooth, curved, convex shape, it is to be understood that alternative shapes may also be used. For example, FIG. 22 illustrates an alternative embodiment of the throat portion 42' having an alternative embodiment of the inner surface 58'. The inner surface 58' includes a frusto-conical portion 84' and a cylindrical portion 88' extending axially from the narrow end of the frusto-conical portion 84'. In such embodiments, the frusto-conical portion 84' includes a first constant surface angle 80*a*' that transitions to a second surface angle 80*b*' at the cylindrical portion 88'. Such an inner surface 58' does not include any concave portions (e.g., instances where the surface angle 80*a*', 80*b*' increases as it extends from the first end 62' to the second end 66').

Figure 8:
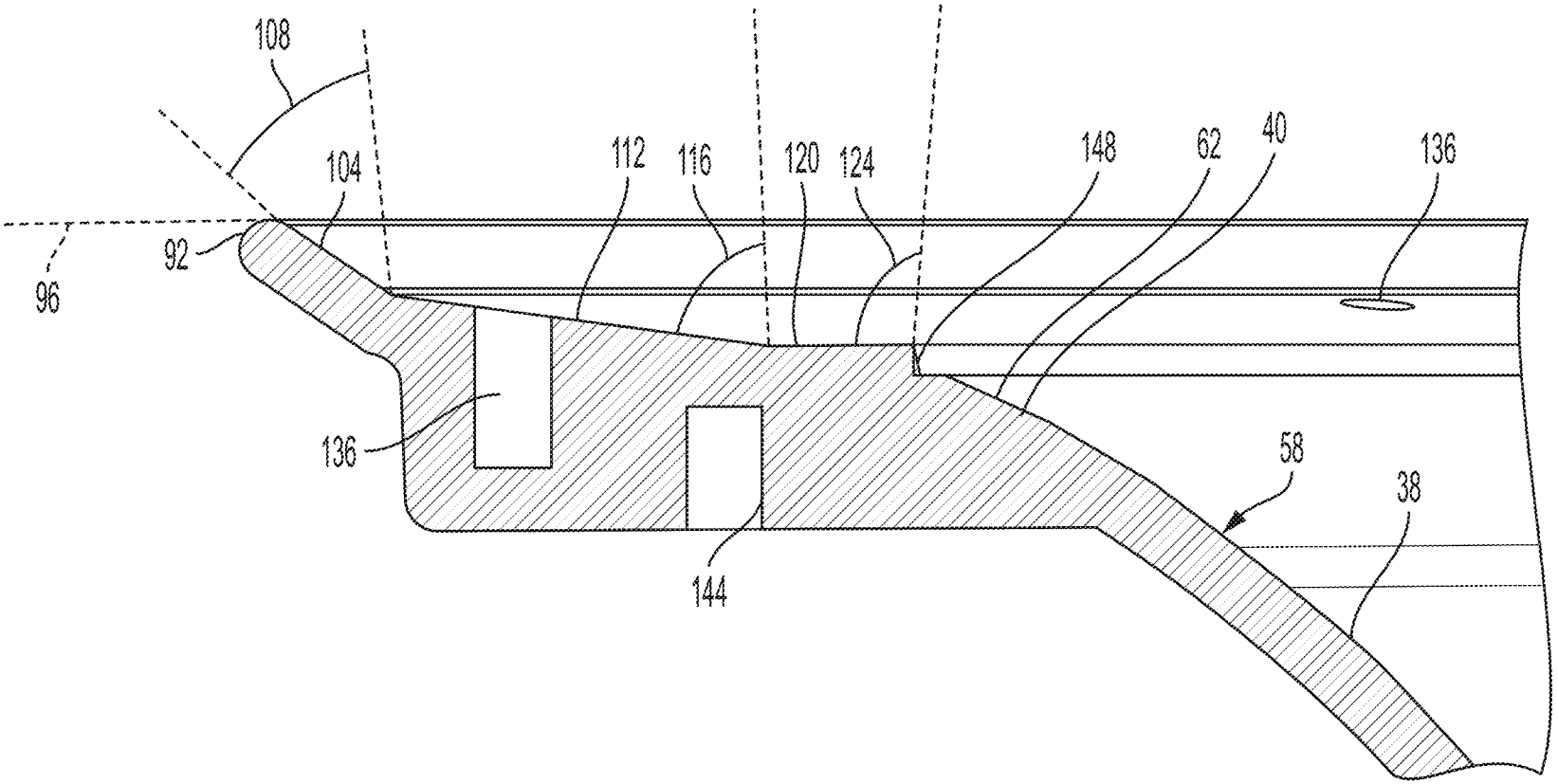
FIG. 8 is a detailed section view taken from FIG. 7.

The flange portion 46 of the base 18 extends radially outwardly from the first end 62 of the throat portion 42 to produce an outer edge 92. The outer edge 92, in turn, defines a top plane 96 (e.g., generally oriented normal to the axis 50 and positioned at the axial highest point of the base 18), and an outer diameter 100. The flange portion 46 includes a first portion 104 extending radially inwardly from the outer edge 92 at a first surface angle 108 relative to the axis 50, a second portion 112 extending radially inwardly from the first portion 104 at a second surface angle 116 relative to the axis 50, and a third portion 120 extending radially inwardly from the second portion 112 at a third surface angle 124. As shown in FIG. 8, the first surface angle 108 is less than the second surface angle 116 (e.g., the first surface angle 108 is steeper than the second surface angle 116), and the second surface angle 116 is less than the third surface angle 124 (e.g. the second surface angle 116 is steeper than the third surface angle 124).

When installed, the top plane 96 of the flange portion 46 is generally positioned so that is aligned with the top surface 130 of the roof 14 positioned immediately adjacent thereto. As such, any roof membrane or paper 152 can transition from the roof 14 to the base 18 without producing any high spots or bumps. For the purposes of this application, the top surface 130 of the roof 14 is generally defined as the surface upon which the roof paper 152 is laid (e.g., the top surface of the concrete) and does not include any gravel positioned thereon. Stated differently, the top surface 130 is substantially aligned with the top plane 96. In alternative embodiments, the roof drain 10 may be mounted to a deck plate or other installation apparatus whereby the top surface 130 may include the upper surface of the deck plate upon which the roof paper 152 is laid proximate the roof drain 10.

When the drain 10 is assembled, the second portion 112 and second surface angle 116 are generally configured to match the angle and radial width of the underside of the gravel ring 30 (described below). Similarly, the third portion 120 and third surface angle 124 are generally set to match with the angle and radial size of the underside of the dome 26. (See FIG. 5). While the second and third portions 112, 120 are shown having different surface angles in the illustrated embodiment, it is understood that in other embodiments, they may be the same.

Figure 5:
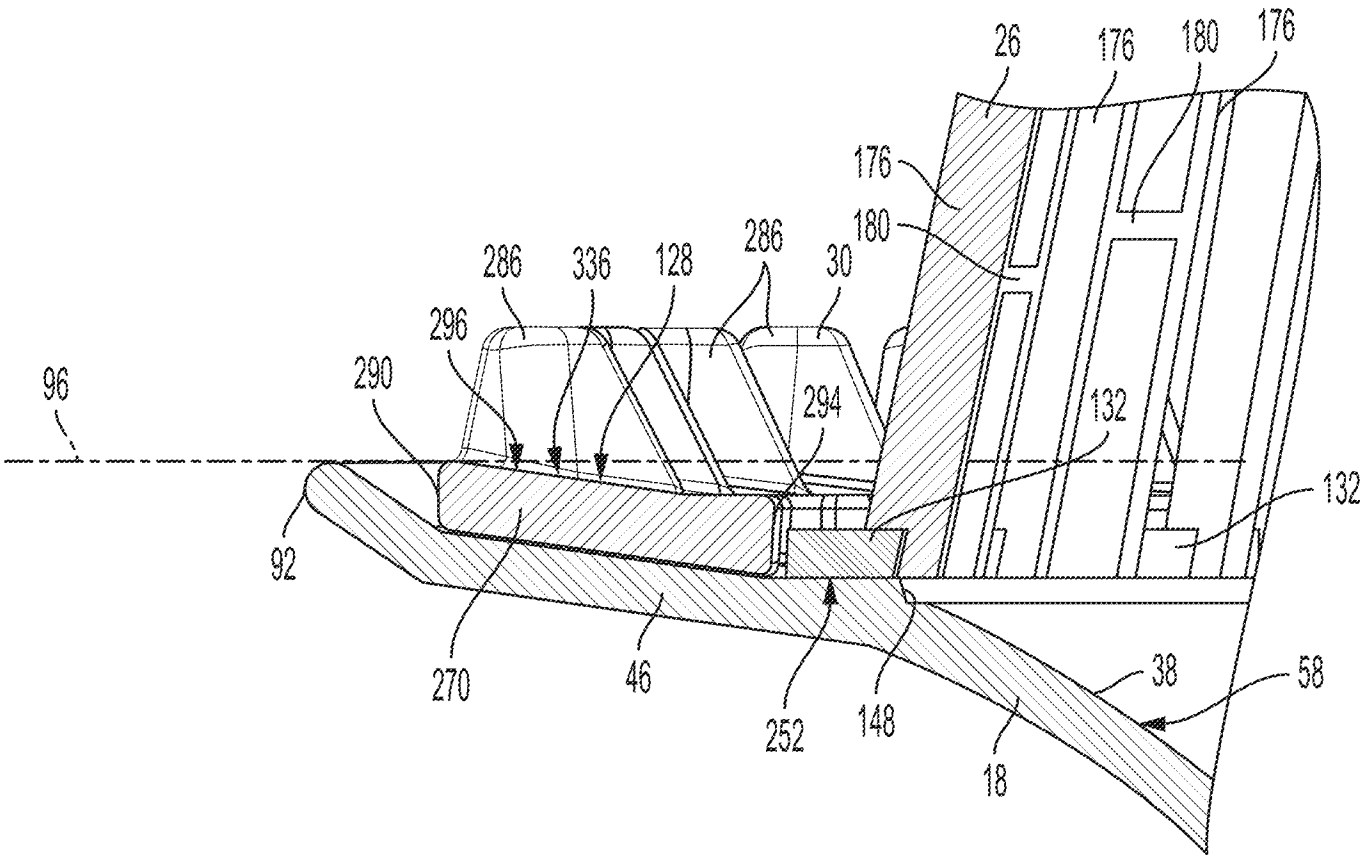
FIG. 5 is a detailed section view taken from FIG. 4.

As shown in FIG. 5, the first portion 104 of the flange portion 46 is sized and shaped such that the outer edge 92 is positioned axially above the remainder of the flange portion 46 when the drain 10 is installed in an upright orientation (e.g., when the axis 50 is substantially vertical in orientation). With the drain 10 assembled, the first portion 104 is sized and shaped such that the outer edge 92 is positioned axially above the low point 126 of at least one gullet 128 of the gravel ring 30 (described below) and the base plates 132 of the dome 26 (described below). In the illustrated embodiment, the outer edge 92 is positioned axially above the low point 126 of each gullet 128 of the gravel ring 30 and above each base plate 132 of the dome 26. Stated differently, the low point 126 of at least one gullet 128 and at least one base plate 132 are positioned axially below the top plane 96. In the illustrated embodiment, the low point 126 of each gullet 128 and each base plate 132 are positioned axially below the top plane 96.

By elevating the outer edge 92 as described above, the drain 10 is configured so that water entering the drain 10 by flowing over the outer edge 92 (e.g., with the outer edge 92 installed level with the roof 14; see FIG. 4) will only encounter flow-paths that are vertically below the point of entry. As such, the water is able to more easily and efficiently flow into the channel 38. This is especially true when the water level on the roof 14 is low. Stated differently, the rainwater from the roof 14 can flow over the outer edge 92, through one or more gullets 128, over and between the dome base plates 132, and into the channel 38 without having to rise higher than the outer edge 92. Stated differently, the drain 10 is configured such that a continuous flow path can be traced from the outer edge 92 to the outlet 22 without rising above the top plane 96.

The base 18 also includes a first plurality of threaded apertures 136 formed into the flange portion 46 and outside the channel 38. During use, the threaded apertures 136 are configured to receive a threaded fastener 140 therein to couple the gravel ring 30 to the base 18. Similarly, the base 18 includes a second plurality of threaded apertures 144 on the underside thereof for securing the base 18 to the roof 14 or other building structure.

Figure 6:
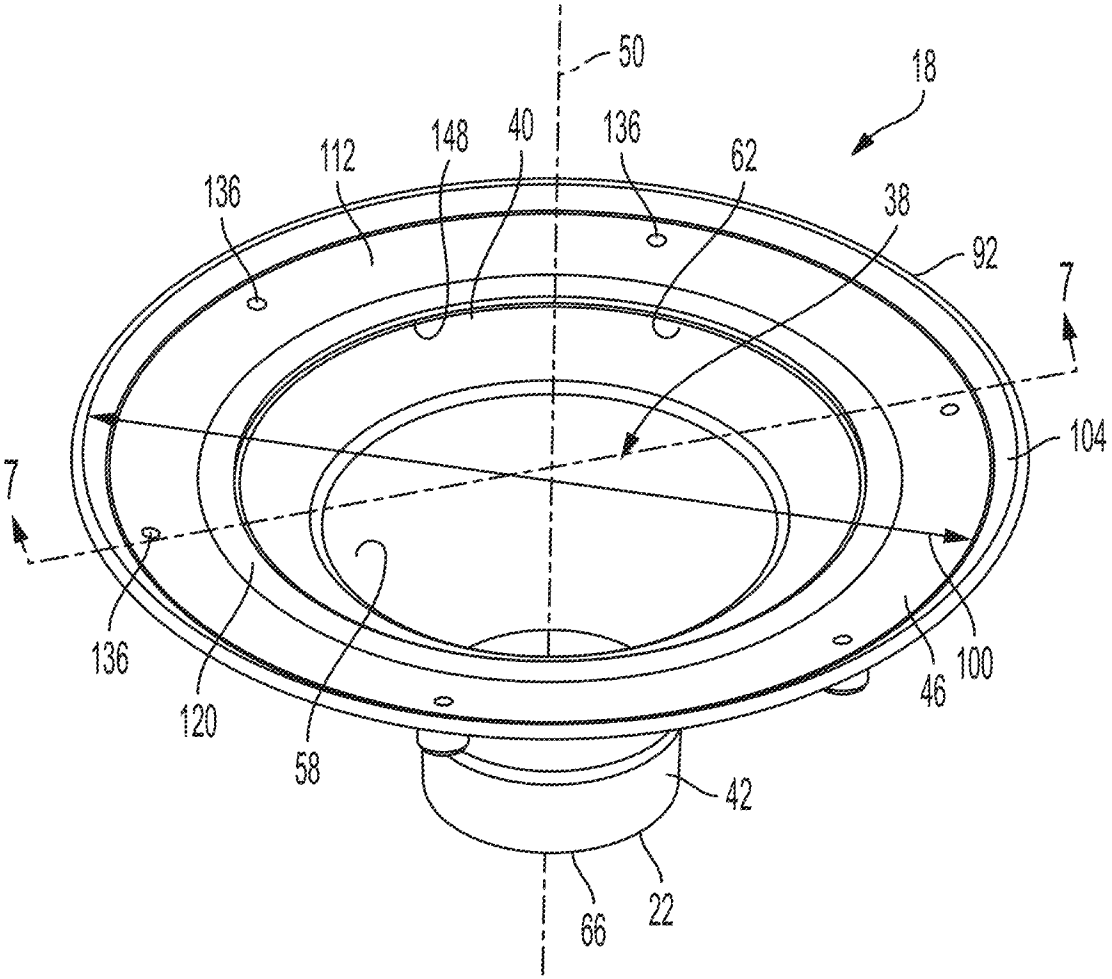
FIG. 6 is a perspective view of a base from the drain of FIG. 1.

The base 18 also includes a cutting groove 148. The cutting groove 148 is formed into the base 18 at a first radial distance from the axis 50. During use, the cutting groove 148 is configured to receive and guide the tip of a knife or razor blade therein so the user can quickly and easily trim the roof paper 152 at the desired location. In the illustrated embodiment, the cutting groove 148 includes a "step" having two adjacent surfaces against which the user's blade may be pressed (e.g., into the corner formed by the two surfaces). However, in alternative embodiments, the groove 148 may be enclosed on three sides (not shown). In still other embodiments, the cutting groove 148 may include other shapes and contours desirable to directing the user during the cutting process. While the illustrated groove 148 is annular in shape, in alternative embodiments, alternative shapes (e.g., polygonal, stepped, and the like) may also be present to produce the desired final cut dimensions. As shown in FIG. 6, the cutting groove 148 of the base 18 is positioned radially inward of the gravel ring 30. The cutting groove 148 is also positioned radially inwardly of the outer diameter 156 of the dome 26 (described below). In some embodiments, the cutting groove 148 may be positioned at a location where the throat portion 42 meets the flange portion 46 at the radially inner barrier of the third portion 120 of the flange portion 46.

As shown in FIG. 4, the outlet 22 of the channel 38 generally defines an outlet diameter 24 generally corresponding to the size of the pipes forming the downspout of the plumbing system. For example, an outlet 22 having a 2" diameter substantially corresponds with a downspout formed from 2" pipe, an outlet having a 3" diameter substantially corresponds with a downspout formed from 3" pipe, and the like. It is understood that the size of the drain 10 may vary proportionally dependent upon the outlet diameter 24 of the outlet 22.

Figure 9:
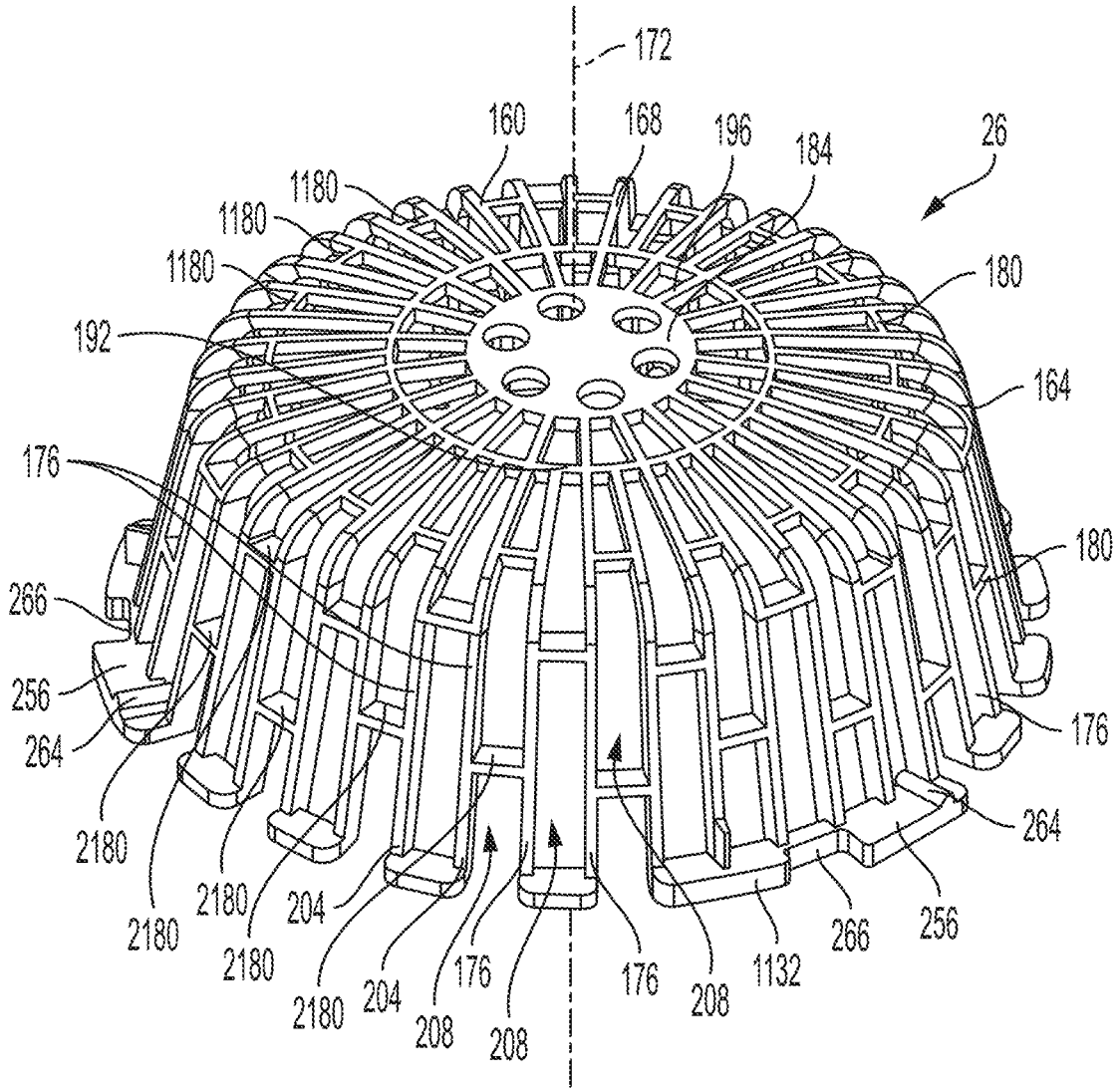
FIG. 9 is a perspective view of a dome from the drain of FIG. 1.
Figure 10:
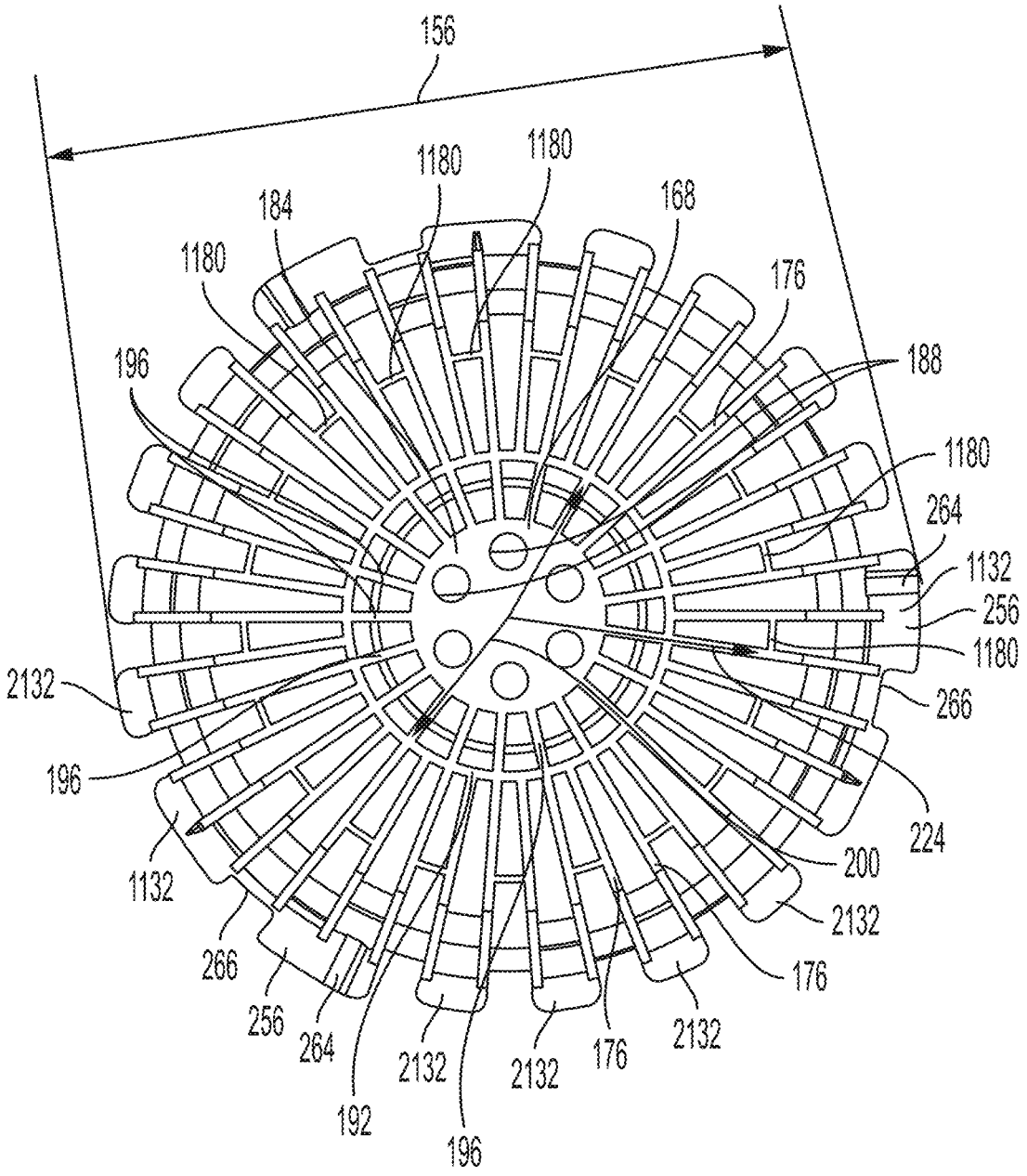
FIG. 10 is a top view of the dome of FIG. 9.
Figure 11:
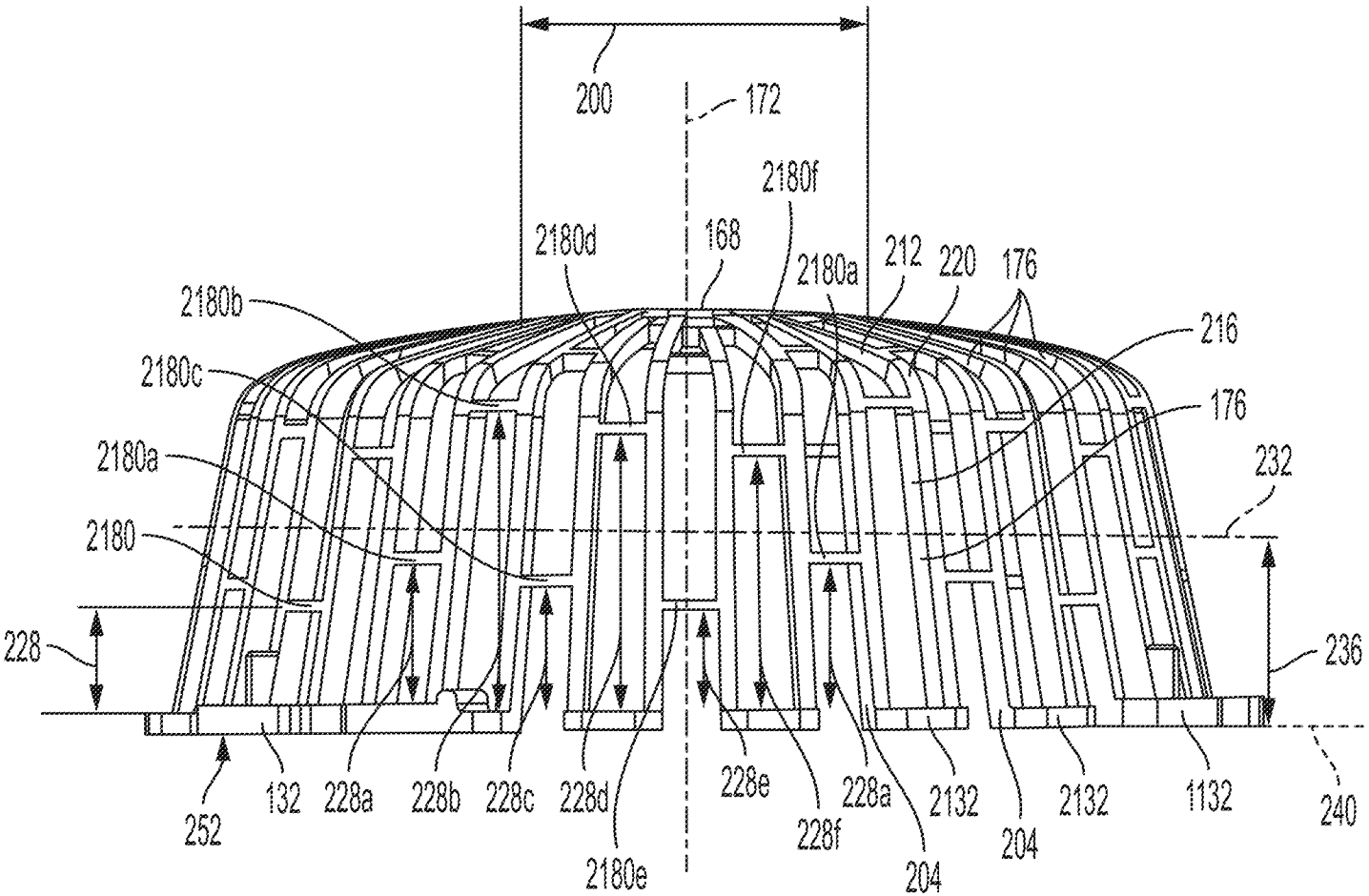
FIG. 11 is a side view of the dome of FIG. 9.

Illustrated in FIGS. 9-11, the dome 26 of the roof drain 10 is coupleable to the flange portion 46 of the base 10 and configured to at least partially enclose the inlet 40 of the channel 38. More specifically, the dome 26 acts as a filter by not allowing large items (e.g., rocks, sticks, and other debris) to enter the channel 38 during use. The dome 26 is also configured to maximize the volume of water that may flow into the channel 38 at any given time. The dome 26 does this by maximizing the percentage of the exterior surface area thereof that is open for water to pass therethrough for a given dome 26 size.

The dome 26 is substantially cylindrical in shape having an upper surface 160 and a side surface 164 extending along the perimeter for the upper surface 160. The dome 26 also includes a core element 168 defining a central axis 172, a plurality ribs 176 extending radially outwardly from the core element 168, and a plurality of crossbars 180 extending between and interconnecting select adjacent ribs 176. The core element 168 of the dome 26 is substantially disk shaped having a central disk 184 defining a plurality of apertures 188 therein, a concentric ring 192 spaced radially outward from the central disk 184, and a plurality of splines 196 extending radially between the central disk 184 and the concentric ring 192. The core element 168 also defines an outer core diameter 200. In alternative embodiments, additional styles and shapes of core elements may be present such as, but not limited to, a solid or perforated disk, a dish-shaped element, a plurality of concentrically located rings, a plurality of radially or otherwise oriented splines, and the like.

The ribs 176 of the dome 26 each extend radially outwardly from the core element 168 to produce a respective distal end 204. Together, the ribs 176 are generally spaced equally from one another in a circumferential direction to produce a plurality of equally sized gaps 208 therebetween. Each rib 176, in turn, includes a first leg or portion 212 extending radially outwardly from the core element 168, and a second leg or portion 216 extending from the first leg 212 at an angle with respect thereto to produce the distal end 204. Each rib 176 also includes a bend or transition 220 where the first leg 212 and second leg 216 meet.

As shown in FIG. 9, the first leg 212 of each rib 176 is oriented substantially perpendicular to the axis 172 (e.g., forming an angle therebetween of approximately 70 and 100 degrees, for example 81 degrees) and generally corresponds with the upper surface 160 while the second leg 216 of each rib 176 is oriented substantially parallel to the axis 172 (e.g., forming an angle therebetween of approximately 0 and 20 degrees, for example 12 degrees) and generally corresponds with the side surface 165 of the dome 26. In still other embodiments, the first leg 212 and the second leg 216 form an angle therebetween of approximately 90 to 120 degrees, for example 112 degrees.

The crossbars 180 of the dome 26 extend between and are coupled to adjacent ribs 176. Each crossbar 180 is generally positioned at various locations along the lengths of the ribs 176 and oriented substantially perpendicular thereto. As shown in FIG. 9, the crossbars 180 are positioned such that no crossbars 180 are located at the transition 220 between the first leg 212 and the second leg 216 (e.g., the transition 220 region of the dome 26 is not completely enclosed). Stated differently, each gap 208 of the dome 26 is open at the transition 220. The crossbars 180 are also position such that each crossbar 180 is not aligned with any crossbars 180 positioned in the adjacent gaps 208. While the illustrated crossbars 180 are generally elongated in shape and oriented perpendicular to the corresponding ribs 176, it is understood that in alternative embodiments the crossbars 180 may have different sizes and shapes and be oriented at various angles relative to the ribs 176.

In the illustrated embodiment, the dome 26 includes a first set of crossbars 1180 and a second set of crossbars 2180. Each crossbar 1180 of the first set of crossbars extends between the first legs 212 of the ribs 176 and are each located at a first radial distance 224 from the axis 172. As shown in FIG. 10, the first set of crossbars 1180 are located in every-other gap 208 around the circumference of the dome 26. In the illustrated embodiment, the first radial distance 224 is greater than the outer core diameter 200 but less than the diameter at which the transition 220 is located. In alternative embodiments, the first set of crossbars 1180 may be positioned in different patterns such as, but not limited to, having each crossbar 1180 at a different radial distance than adjacent crossbars; having the crossbars spiral radially outwardly or inwardly, having a random pattern where no adjacent crossbars align, and the like.

Each crossbar 2180 of the second set of crossbars extends between the second legs 216 of the ribs 176 at a corresponding "bar height" 228. For the purposes of this application, the bar height 228 is generally defined as the distance between the crossbar 180 and the distal end 204 of the corresponding rib 176.

The second set of crossbars 2180 are generally positioned so that they alternate above and below a datum plane 232 oriented normal to the axis 172 and located at a predetermined datum height 236. For the purposes of this application, the datum height 236 is generally defined as the axial distance between the datum plane 232 and the base plane 240 of the dome 26 (described below). In some embodiments, the datum plane 232 may be positioned at the midpoint such that the datum height 236 is half the overall axial height 244 of the dome 26. In other embodiments, the datum plane 232 may be positioned at different datum heights 236 to accommodate different flow patterns.

As shown in FIG. 11, the second set of crossbars 2180 are positioned such for a given crossbar 2180, both adjacent crossbars 180*b* are located to one side thereof (e.g., either above or below). For example, for a select crossbar 2180 having a given bar height 228, both adjacent crossbars 2180 will have a bar height 228 that is either both greater than or both less than the given bar height 228.

More specifically, the second set of crossbars 2180 are positioned to produce a repeating pattern about the circumference of the dome 26. Specifically, the first crossbar 2180*a* of the pattern includes a first bar height 228*a*, the subsequent second crossbar 2180*b* has a second bar height 228*b* that is greater than the first bar height 228*a*, the subsequent third crossbar 2180*c* has a third bar height 228*c* that is less than the second bar height 228*b*, the subsequent fourth crossbar 2180*d* has a fourth bar height 228*d* that is greater than the third bar height 228*c*, the subsequent fifth crossbar 2180*e* has a fifth bar height 228*e* that is less than the fourth bar height 228*d*, and the subsequent sixth crossbar 2180*f* has a sixth bar height 228*f* that is greater than the fifth bar height 228*e*. In instances where six crossbars 2180 are included in the pattern, the sixth bar height 228*f* is also greater than the first bar height 228*a*. However, in alternative embodiments, additional or fewer crossbars 2180 may be included in the pattern as necessary (e.g., four crossbars, five crossbars, seven crossbars, eight crossbars, nine crossbars, and the like).

As shown in FIG. 11, in addition to the alternating pattern of the crossbars 2180 described above, the second set of crossbars 2180 also step-down (e.g., the bar heights 228 reduce) as the pattern progresses. For example, for the sub-set of crossbars 2180 positioned above the datum plane 232 (e.g. the second, fourth, and sixth crossbars 2180*b*, 2180*d*, 21800 the fourth bar height 228*d* is less than second bar height 228*b* and the sixth bar height 228*f* is less than the fourth bar height 228*d*. With respect to the sub-set of crossbars 2180 positioned below the datum plane 232 (e.g., the first, third, and fifth crossbars 2180*a*, 2180*c*, 2180*e*), the third bar height 228*c* is less than the first bar height 228*a* and the fifth bar height 228*e* is less than the third bar height 228*c*. Viewed together as a group, none of the six crossbars 2180 in the repeating pattern have the same bar height 228 (e.g., the first, second, third, fourth, fifth, and sixth bar heights 228*a-f* are all different).

Figure 23:
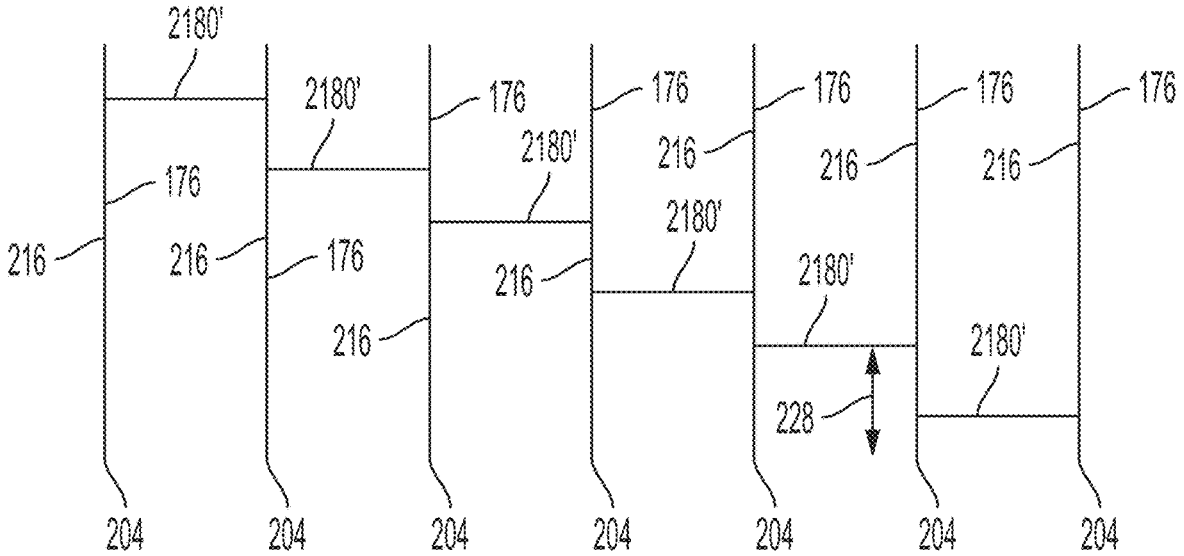
FIGS. 23-26 illustrate alternative embodiments of the crossbars of the dome.

FIG. 23 illustrates another embodiment of the second set of crossbars 2180'. The second set of crossbars 2180' produce a "step-down" pattern where each crossbar 2180' has a bar height 228 that is less than the previous crossbar 2180' when taken in a given rotational direction. In such embodiments, the illustrated pattern may repeat over the circumference of a given dome. While the illustrated pattern shows six crossbars 2180', it is understood that more or fewer crossbars 2180' may be present.

Figure 24:
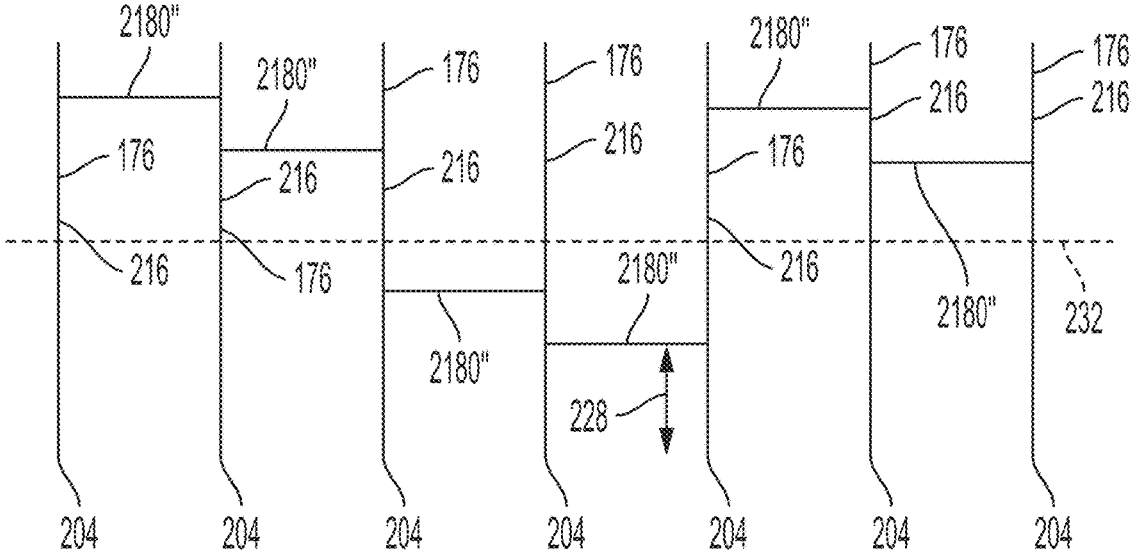

FIG. 24 illustrates another embodiment of the second set of crossbars 2180". The second set of crossbars 2180" generally produces an alternating pattern where groups of crossbars 2180" (e.g., two crossbars) alternate above and below the datum 232. While the illustrated embodiment includes two crossbars 2180" in each group, alternative embodiments may include more or fewer crossbars 2180" in each group. Furthermore, while the illustrated embodiment shows the crossbars 2180" in a given group not aligning with each other, it is understood that in some embodiments the crossbars 2180" within a given group may align with each other.

Figure 25:
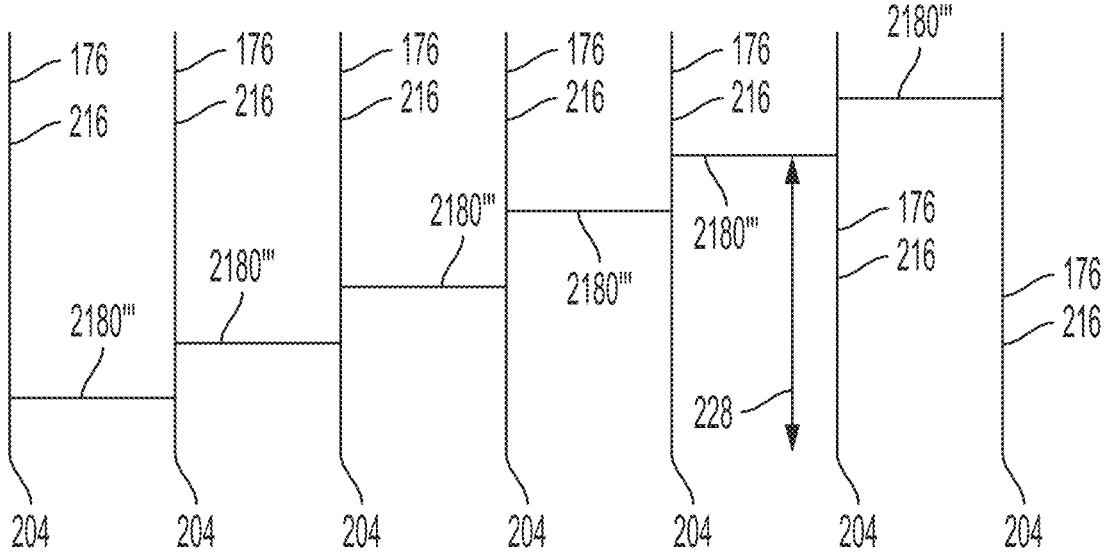

FIG. 25 illustrates another embodiment of the second set of crossbars 2180'". The second set of crossbars 2180'" generally produces a "step-up" pattern where each crossbar 2180'" has a bar height 228 that is greater than the previous crossbar 2180'" when taken in a given rotational direction. In such embodiments, the illustrated pattern may repeat over the circumference of a given dome. While the illustrated pattern shows six crossbars 2180''', it is understood that more or fewer crossbars 2180''' may be present.

Figure 26:
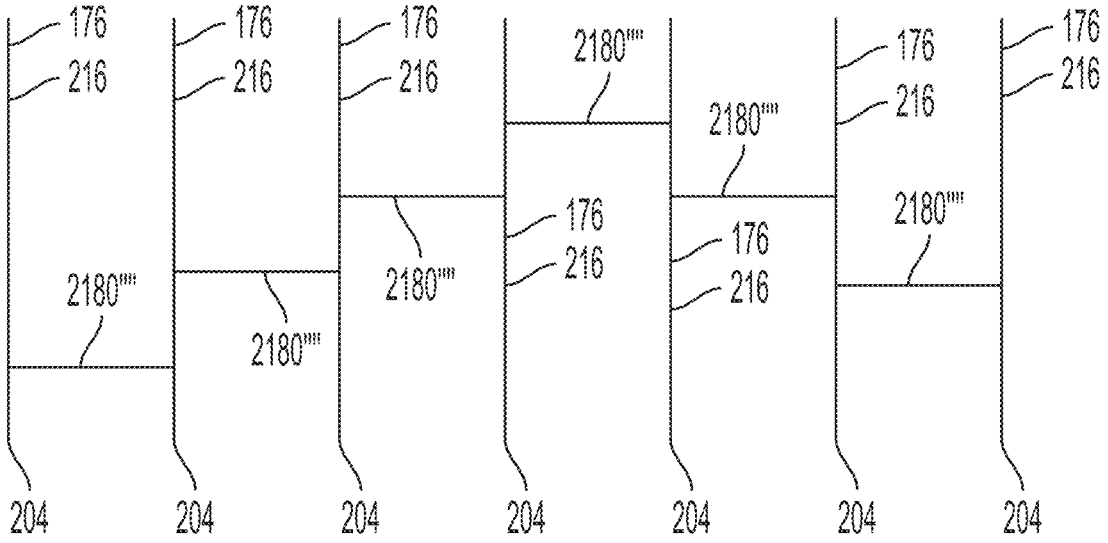

FIG. 26 illustrates another embodiment of the second set of crossbars 2180''''. The second set of crossbars 2180'''' generally produces a "chevron" pattern where the crossbars 2180'''' alternate between step-up and step-down patterns. In the illustrated embodiment, the alternating step-up and step-down patterns continue over the entire circumference of the dome.

While the illustrated crossbars 180 are oriented as described above, it is understood that additional patterns may be present. Furthermore, the pattern may be expanded to include more or fewer crossbars 180 as necessary and to accommodate different numbers of ribs 176 and dome 26 sizes.

The dome 26 also includes a set of base plates 132, each coupled to the distal end 204 of one or more ribs 176 and configured to support the dome 26 on the base 18. In the illustrated embodiment, the base plates 132 do not completely enclose the bottom of the dome 26, rather, at least one of the gaps 208 between adjacent ribs 176 are open (e.g., not enclosed at the bottom of the dome 26). When the drain 10 is assembled, the base plates 132 are positioned completely axially below the top plane 96. Furthermore, the gaps between the base plate 132 also extend axially below the top plane 96. As shown in FIG. 4, the base plates 132 are also positioned below the finished surface 146 of the roof 14 positioned immediately adjacent to the drain 10. For the purposes of this application, the finished surface 146 of the roof 14 is defined as the surface of the roof on which gravel is laid immediately adjacent to the drain 10. In FIG. 4, the finished surface 146 is the top surface of the roof paper 152, however, the finished surface 146 may include the top surface 130 of the roof 14 (e.g., when no paper 152 is present) or the top surface of a deck plate immediately adjacent to the drain 10 (not shown) when used. The gaps between the base plates 132 also extend below the finished surface 146 of the roof 14 positioned immediately adjacent to the drain 10.

As shown in FIG. 9, the base plates 132 of the dome 26 include a first set of locating base plates 1132 and a second set of intermediate base plate 2132. Together, the first set and second set of plates 1132, 2132 define a base plane 240 of the dome 26. As shown in FIG. 11, the base plane 240 is generally oriented substantially normal to the axis 172. In the illustrated embodiment, the bottom surfaces 252 of the base plates 132 are all slightly angled relative to the axis 172 so that bottom surfaces 252 substantially match and align with the flange portion 46 of the base 18 (e.g., the third portion 120). However, in alternative embodiments it is understood that the bottom surfaces 252 may be normal to the axis 172 or contoured as necessary to accommodate the base 18 and the gravel ring 30. In some embodiments, protrusions or grooves may be included to aid the alignment between the dome 26, gravel ring 30, and base 18. Together, the base plates 132 also define an outer diameter 156 of the dome.

The first set of base plates 1132 are each substantially elongated in shape extending along and being coupled to one or more distal ends 204 of the ribs 176. During use, the first set of base plate 1132 generally form locking members 256 and are configured to interact with and releasably couple to the gravel ring 30. In the illustrated embodiment, the dome 26 includes three first base plates 1132, each positioned so that they generally correspond and align with a respective locking member 260 of the gravel ring 30 (described below).

The locking members 256 of the dome 26 are configured to both restrict the axial movement of the dome 26 relative to the base 18 (e.g., clamp the dome 26 to the base 18) and rotationally orient the dome 26 relative to both the base 18 and gravel ring 30. As shown in FIG. 9, the illustrated locking members 256 each include a locking ridge 264 and define a locking notch 266 open to the radially outermost edge thereof.

The second set of base plates 2132 are each configured to strengthen and enclose adjacent ribs 176 of the dome 26. As shown in FIG. 9, each base plate 2132 of the second set of base plates extends between and is coupled to the distal ends 204 of adjacent ribs 176. Together, the base plates 2132 are generally spaced apart so that they form alternating open and closed gaps 208 between the ribs 176. While the illustrated plates 2132 are shown to be positioned in every other gap 208, it is understood that in alternative embodiments the size (e.g., the number of ribs 176 an individual base plate 2132 is coupled to) and spacing (e.g., the number of open gaps 208 between adjacent base plates 2132) may be adjusted as needed.

Figure 12:
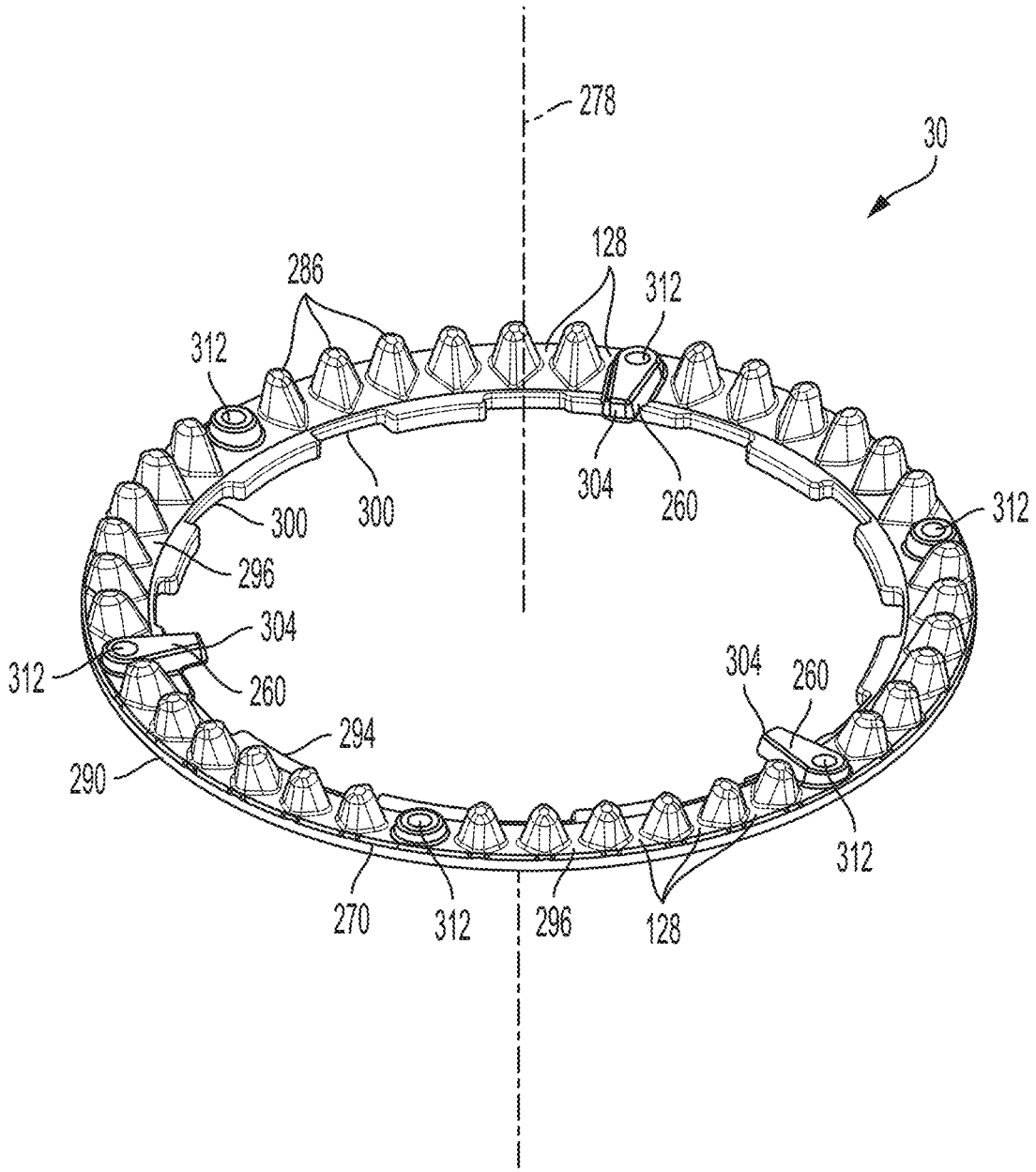
FIG. 12 is a perspective view of a gravel ring of the drain of FIG. 1.
Figure 13:
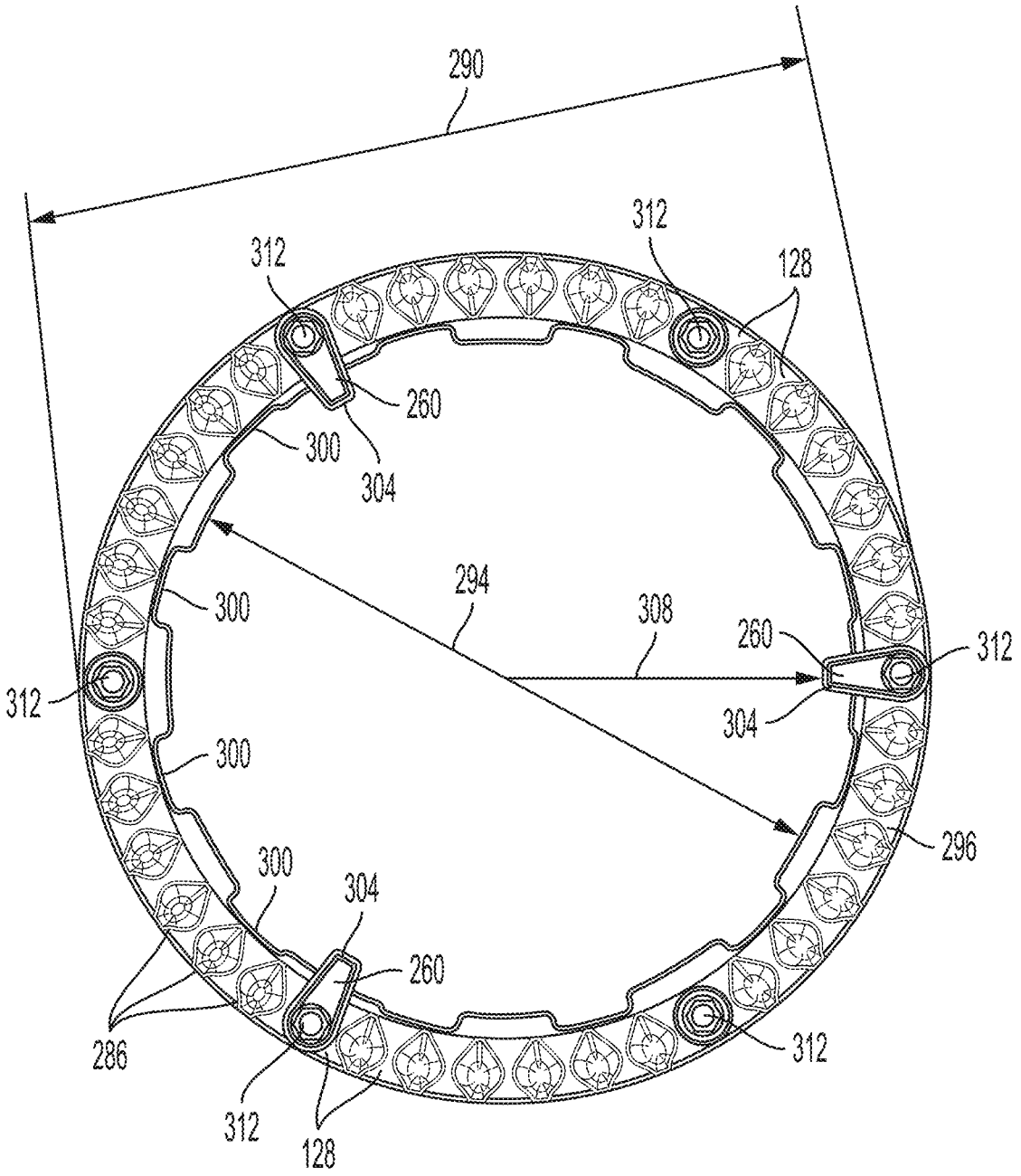
FIG. 13 is a top view of the gravel ring of FIG. 12.
Figure 14:
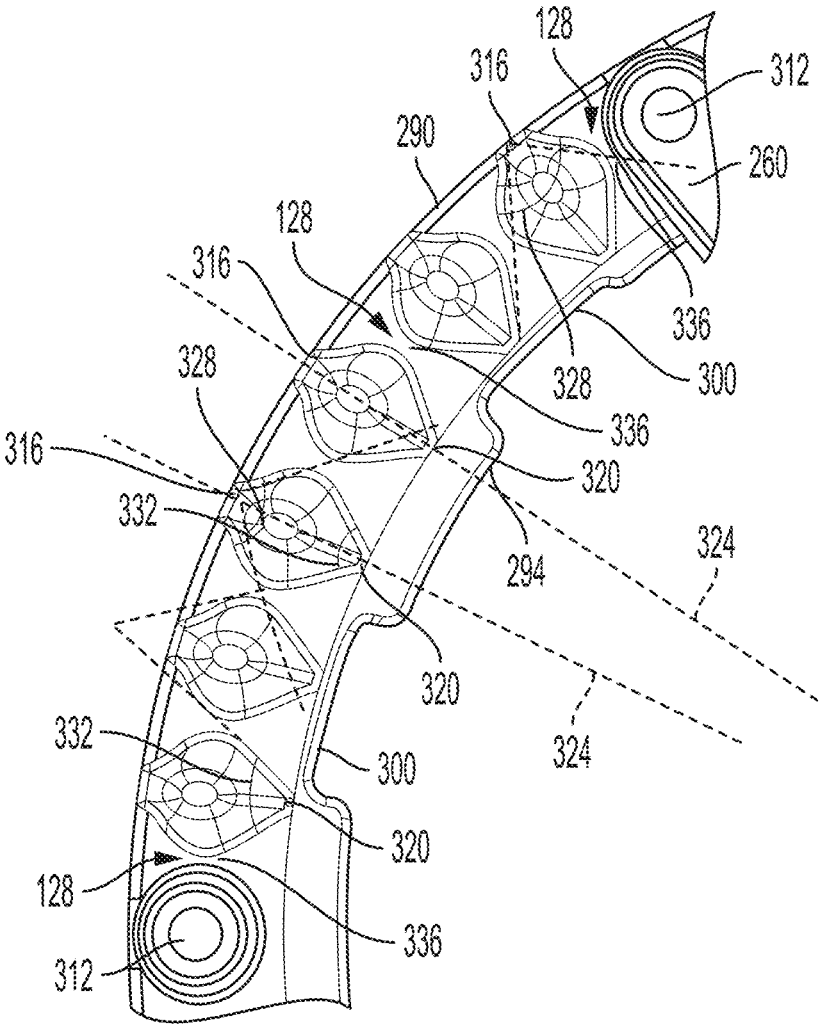
FIG. 14 is a detailed top view taken from FIG. 13.

FIGS. 12-14 illustrate the gravel ring 30 of the roof drain 10. The gravel ring 30 is generally configured to releasably couple the dome 26 to the base 18 in addition to acting as a preliminary filter by restricting the flow of large debris (e.g., gravel, sticks, garbage, and the like) from flowing into the dome 26 and/or channel 38. During installation, the gravel ring 30 is also configured to secure the roof paper 152 to the base 18 of the drain 10.

As shown in FIG. 12, the gravel ring 30 is substantially disk shaped having an annular body 270 defining an outer diameter 274 and an axis 278 therethrough. The gravel ring 30 also includes a plurality of locking members 260, and a plurality of teeth 286.

The body 270 of the gravel ring 30 is annular in shape and defines an outer diameter 290, an inner diameter 294, and an upper surface 296. As shown in FIG. 13, the inner diameter 294 of the body 270 includes a plurality of notches 300 formed therein. Each notch 300 extends radially outwardly (e.g., into the body 270) and is equally spaced along the circumference of the inner diameter 294. During use, the notches 300 allow the user to more easily identify the roof paper 152 when installing the drain 10 onto a roof 14. More specifically, by having the notches 300 formed therein, the user is not required to have as much sheeting inside the drain 10 to satisfy the "visible length" code requirements. Since the presence of roof paper 152 near the channel 38 can disrupt flow patterns and reduce overall flow capacity, minimizing the amount of paper 152 can improve flow characteristics of the drain 10. While the illustrated notches 300 are sized and shape equally about the circumference of the body 270, in alternative embodiments, more or fewer notches 300 may be present. Furthermore, the size and the shape of the notches 300 may vary with respect to one another.

Figure 1:
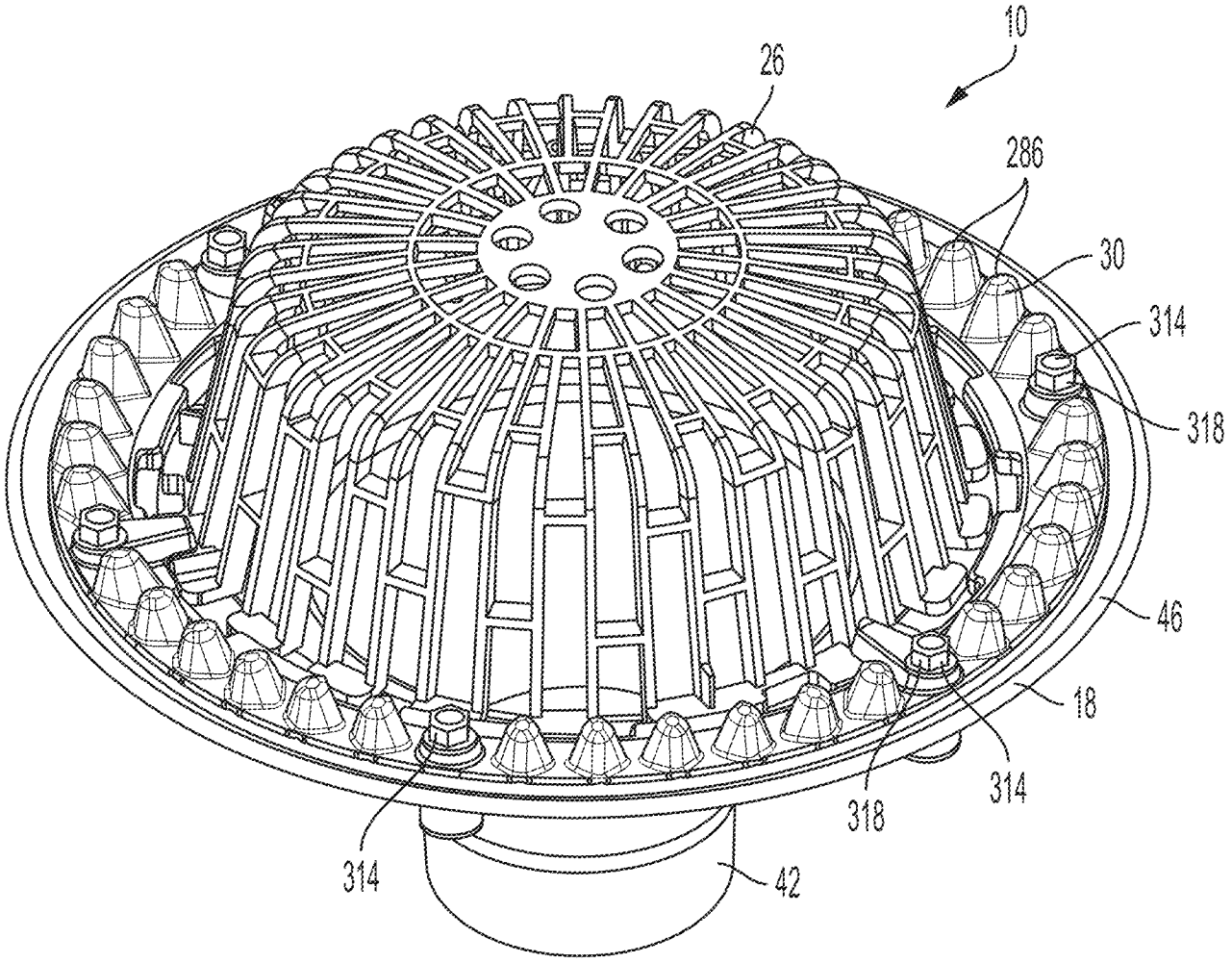
FIG. 1 is a perspective view of drain of the present invention.
Figure 2:
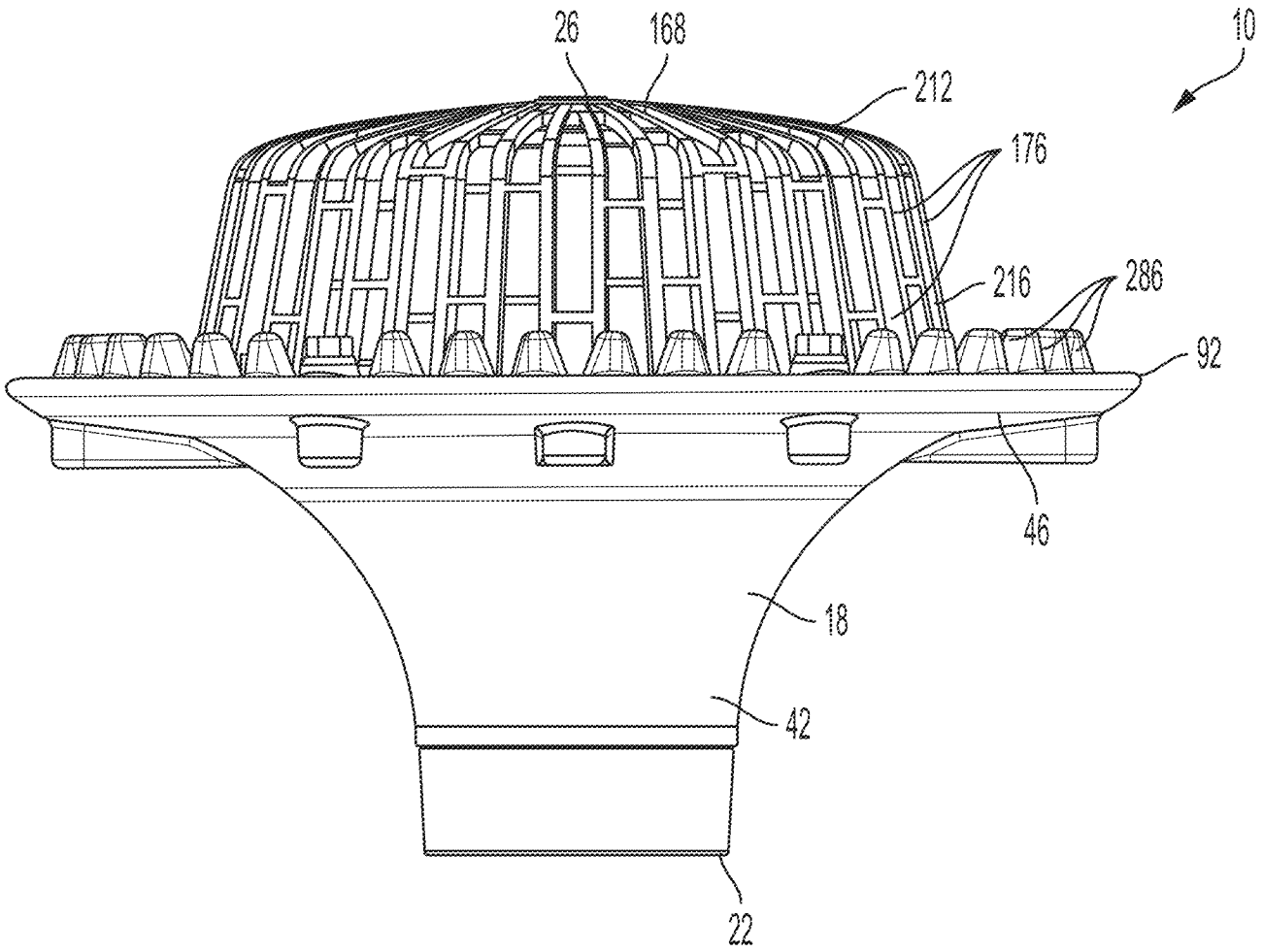
FIG. 2 is a side view of the drain of FIG. 1.
Figure 3:
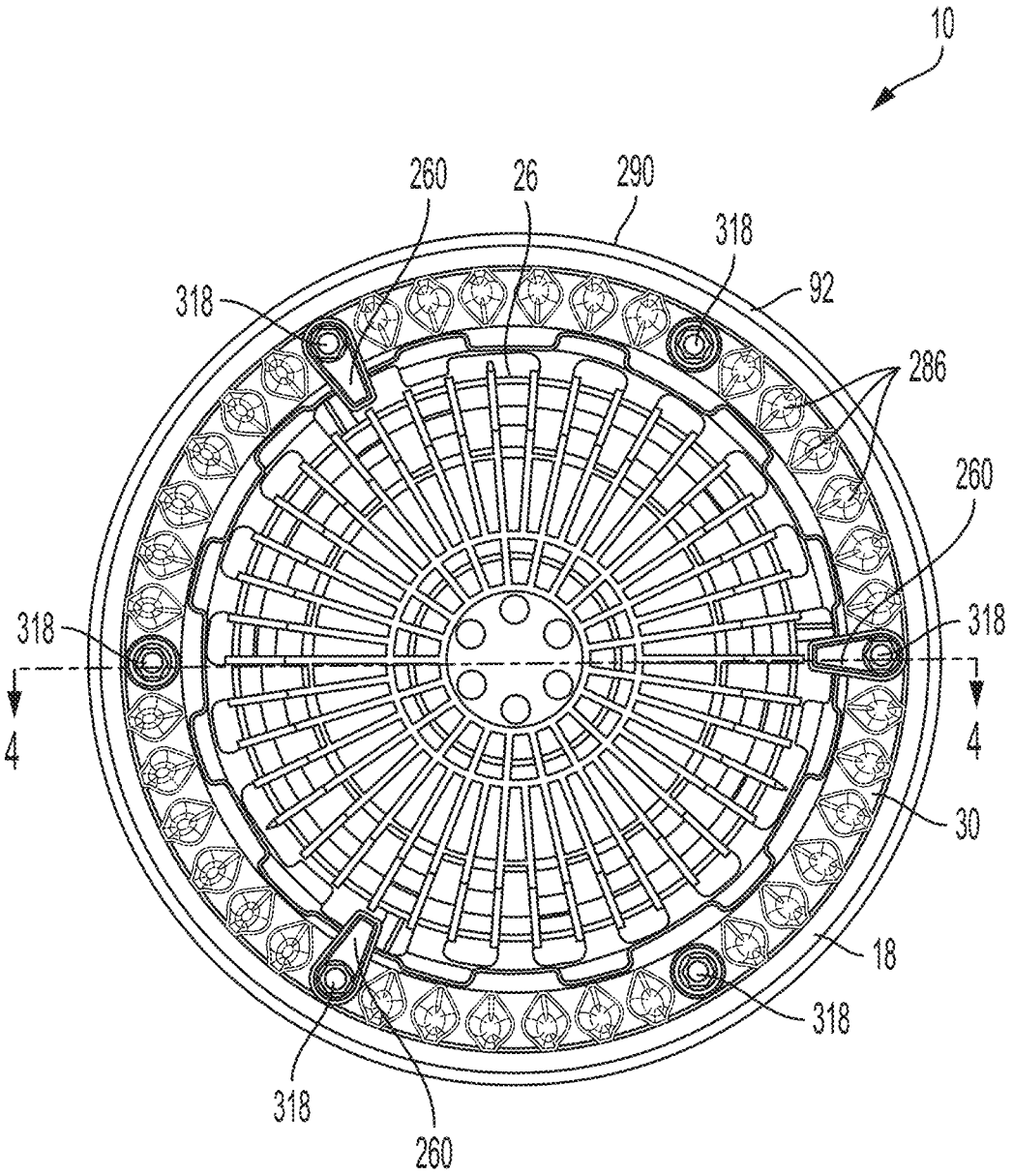
FIG. 3 is a top view of the drain of FIG. 1.

The locking members 260 of the gravel ring 30 are configured to releasably engage with the locking members 256 of the dome 26. More specifically, the locking members 260 of the gravel ring 30 are configured to axially lock the dome 26 against the base 18 while also rotationally aligning the ring 30, dome 26, and base 18. In the illustrated embodiment, the locking members 260 of the gravel ring 30 include a plurality of tabs extending radially inwardly from the body 270 to produce a distal end 304 at a distal end diameter 308. As shown in FIG. 3, the distal end diameter 308 is less than the outer diameter 154 of the dome 26.

The teeth 286 of the gravel ring 30 extend axially from upper surface 296 of the body 270 and are spaced in equal groups about the circumference thereof. More specifically, the illustrated teeth 286 include six groups of six equally spaced teeth 286, each separated by a corresponding bolt aperture 312. Together, the teeth 286 and bolt apertures 312 are all equally spaced about the circumference of the gravel ring 30 and generally located at the same radial distance from the axis 278 (e.g., on the same reference circle centered on the axis 278). As such, when the gravel ring 30 is installed, the head 314 of the fasteners 318 positioned in the bolt apertures 312 serve to act as a "tooth" in the gravel ring 30. By doing so, the fasteners 318 are both easily accessible by the user while minimizing any restrictions to the water flow past the ring 30 itself. As shown in FIG. 4, bolt apertures 312 are positioned radially outside the dome 26.

As shown in FIG. 14, each tooth 286 is substantially "diamond" shaped having a leading point 316 positioned proximate the outer diameter 290 of the body 270, and a trailing point 320 positioned proximate the inner diameter 294 of the body 270. As shown in FIG. 14, the leading point 316 and trailing point 320 of each tooth 286 falls on a datum line 324 extending radially from the axis 278.

Each tooth 286 also includes a leading angle 328 and a trailing angle 332. For the purposes of this application, the leading angle 328 is generally defined as the angle at which the tooth 286 extends from the leading point 316 while the trailing angle 332 is generally defined as the angle at which the tooth 286 extends from the trailing point 320. As shown in FIG. 14, the leading angle 328 is greater than the trailing angle 332. Each tooth 286 is also shaped so that it tapers as it extends axially from the upper surface 296 body 270.

The gravel ring 30 also includes a plurality of gullets 128 formed between a corresponding pair of teeth 286, between a tooth 286 and bolt aperture 312 (e.g., the head 314 of the fastener 318 positioned in the bolt aperture 312), or between a tooth 286 and a locking member 260. The gullets 128, are equally spaced about the entire circumference of the gravel ring 30, including those gullets 128 associated with the bolt apertures 312 and locking members 260.

Each gullet 128, in turn, includes a low point or bottom 336. In the illustrated embodiment, the low point 336 of the gullets 128 lie directly on the upper surface 296 of the body 270. As shown in FIG. 5, the gullets 128 are configured such that, when the gravel ring 30 is attached to the base 18, the low point 336 of at least one gullet 128 is positioned axially beneath the top plane 96. In the illustrated embodiment, each low point 336 is positioned below the top plane 96. Furthermore, the low point 336 of at least one gullet 128 is positioned below the finished surface 146 of the roof 14 immediately adjacent to the drain 10.

In the illustrated embodiment, the number of gullets 128 on the gravel ring 30 and the number of gaps 208 in the dome 26 are multiples of one another. As such, when both the gravel ring 30 and dome 26 are attached to the base 18 (and rotationally aligned using the locking members 256, 260), each of the gullets 128 may be radially aligned with a corresponding gap 208 (e.g., when the number of gullets 128 is less than or equal to the number of gaps 208) or each gap 208 may be radially aligned with a corresponding gullet 128 (e.g., when the number of gaps 208 is less than or equal to the number of gullets 128). This arrangement allows for a more efficient and direct flow path for water to enter the channel 38 during use. In the illustrated embodiment, the number of gullets 128 equals the number of gaps 208.

While the illustrated drain 10 is shown being substantially circular in shape, it is understood that in alternative embodiments, the drain 10 may be rectangular, square, oval, or polygonal in shape.

To install the drain 10 on a roof 14, the user places the base 18 such that the outer edge 92 of base 18 is located substantially level with the top surface 130 of the roof 14 (e.g., the top plane 96 is aligned with the top surface 130; see FIG. 4). With the base 18 located, the user may then secure the drain 10 in place by bolting the base 18 to the roof 14 with fasteners (e.g., using threaded apertures 144 on the bottom side thereof). The user may also attach the outlet 22 of the drain 10 to the building plumbing system 34.

With the base 18 in place, the user may then apply a layer of roof paper 152 to the top surface 130 of the roof 14. When doing so, the user lays the paper 152 over the outer edge 92 so it generally covers the base 18. With the paper 152 roughly positioned, the user may then attach the gravel ring 30 to the base 18. To do so, the user axially places the gravel ring 30 onto the flange portion 46, making sure to align the bolt apertures 312 of the ring 30 with the corresponding threaded apertures 136 of the base 18. The user may then secure the ring 30 to the base 18 using a series of threaded fasteners 318 (see FIG. 1).

With the ring 30 in place, the user may then trim the roof paper 152 by running a blade (e.g., a razor blade or knife) along the cutting groove 148 of the base 18. By doing so, the cutting groove 148 will guide the blade along the desired cutting path, allowing the user to remove the portion of the paper 152 generally covering the channel 38. As described above, the cutting groove 148 is positioned such that the appropriate length and shape of paper 152 remains attached to the drain 10 as required by code. Furthermore, the notches 300 of the gravel ring 30 are positioned such that an increased length of roof paper 152 is exposed after the excess paper has been removed (e.g., the exposed radial length of paper 152 equals the radius of the interior of the notch 300 minus the radius at which the cutting groove 148 is located).

Finally, the user may install the dome 26. To do so, the user aligns each locking member 260 of the gravel ring 30 with a corresponding locking member 256 of the dome 26. More specifically, the user aligns the elements to that the of the gravel ring 30 with a corresponding locking notch 266 of the dome 26. The dome 26 is then axially directed onto the base 18 until the bottom surfaces 252 of the dome 26 contacts the flange portion 46 of the base 18. By doing so, each locking member 260 passes through their corresponding notch 266.

Once in place, the user can then rotate the dome 26 relative to the base 18 and gravel ring 30 causing each locking member 260 to pass over the top of its corresponding base plate 132 until each locking member 260 contacts a respective locking ridge 264. With the locking member 260 in contact with the ridge 264, the dome 26 and ring 30 are rotationally aligned such that the gullets 128 of the ring 30 radially align with the gaps 208 of the dome 26.

Figure 15:
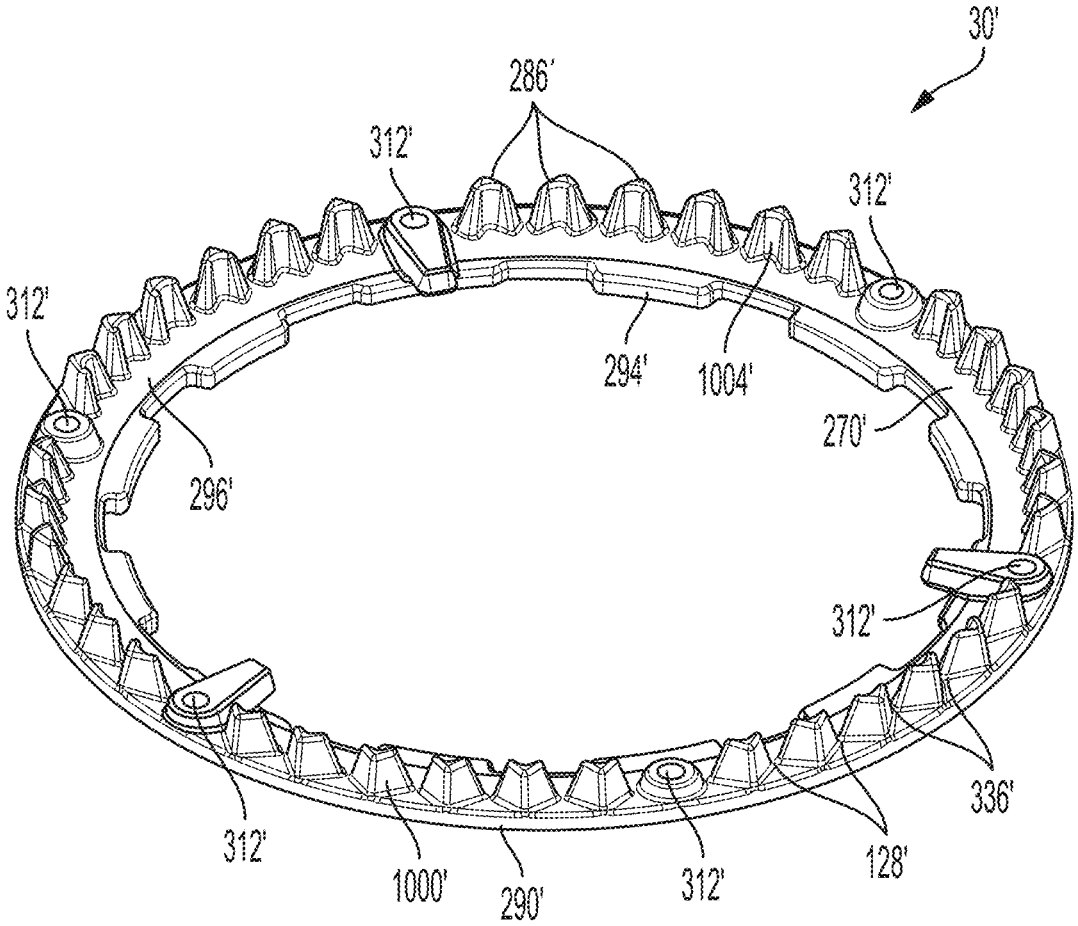
FIG. 15 is another embodiment of a gravel ring.
Figure 16:
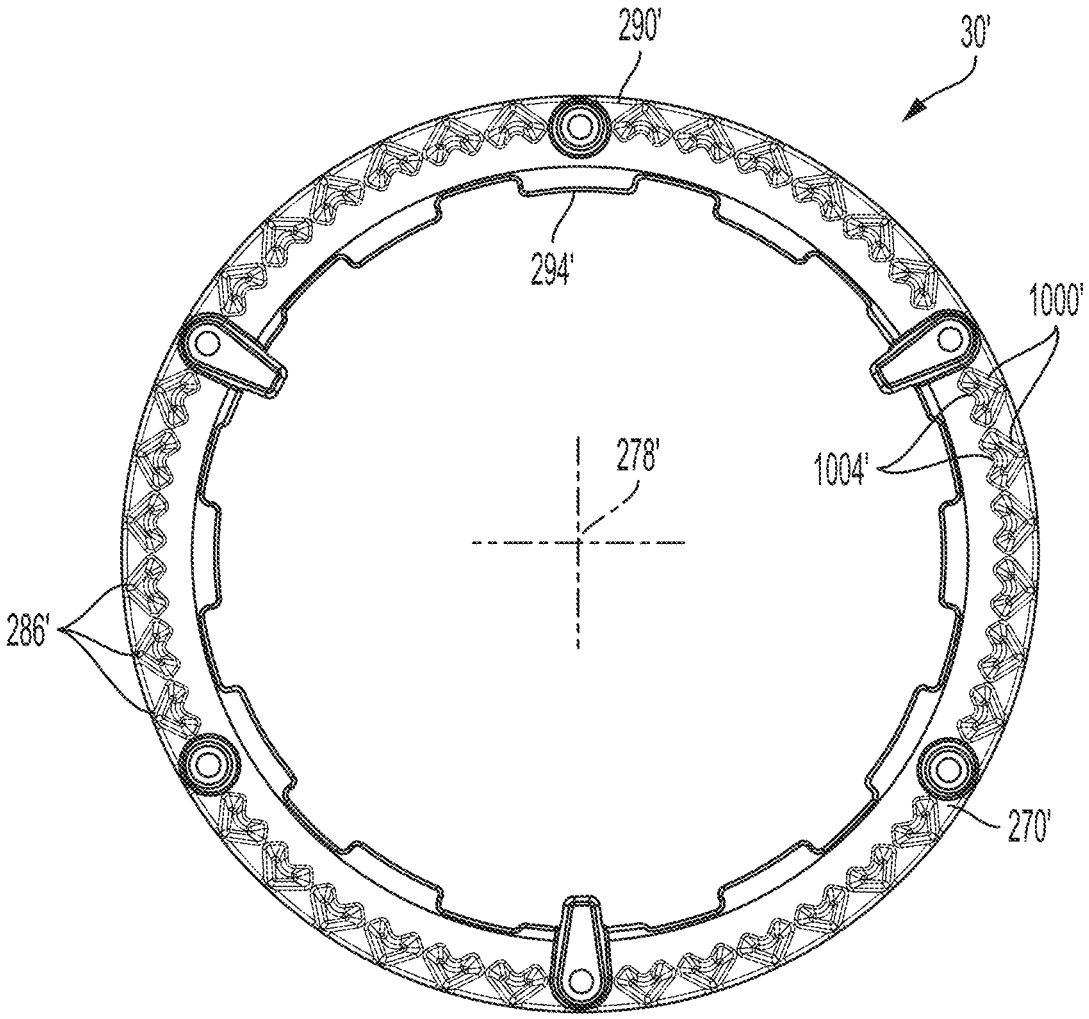
FIG. 16 is a top view of the gravel ring of FIG. 15.
Figure 17:
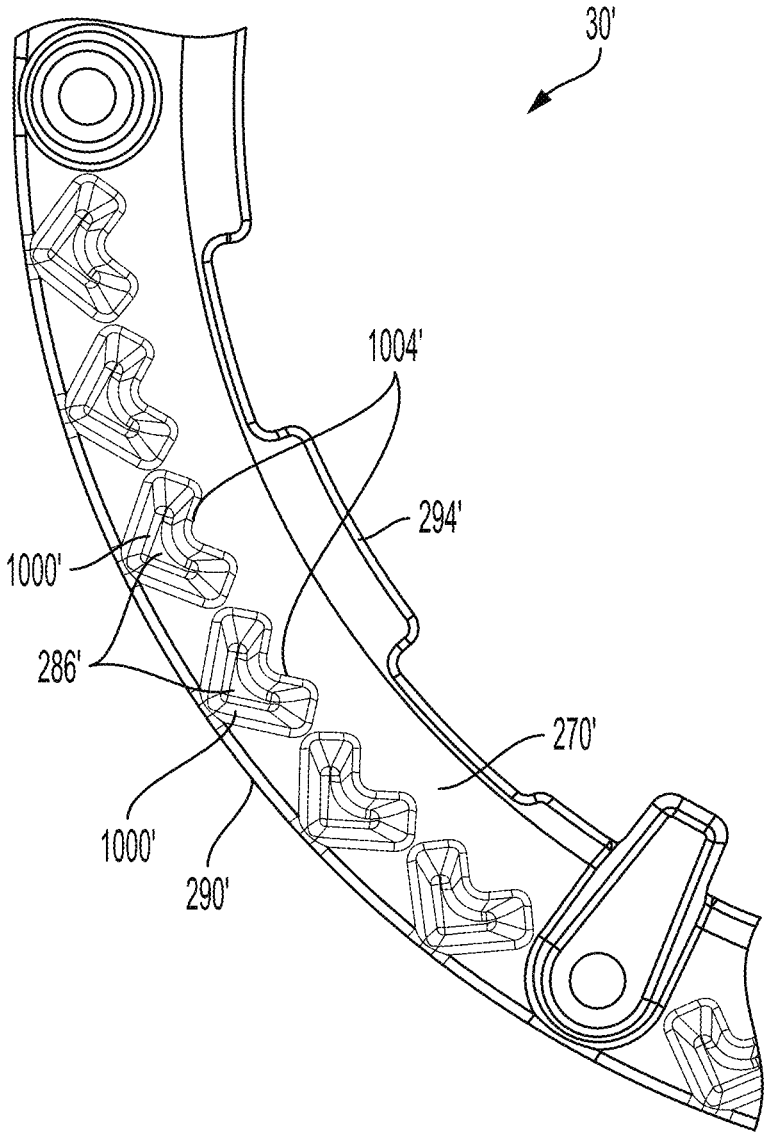
FIG. 17 is a detailed top view taken from FIG. 16.

FIGS. 15-17 illustrate another embodiment of the gravel ring 30'. The gravel ring 30' is substantially similar to the gravel ring 30 so only the difference will be discussed in detail herein. The gravel ring 30' includes a plurality of teeth 286', and one or more bolt apertures 312'. Together, the teeth 286' and bolt apertures 312' are equally spaced along the circumference of the body 270' of the ring 30' with a gullet 128' being formed between each element. As shown in FIG. 16, both the teeth 286' and bolt apertures 312' are all located substantially the same radial distance from the axis 278'.

The gravel ring 30' includes a plurality of teeth 286' having a substantially chevron shape. More specifically, each tooth 286' includes a leading surface 1000' positioned proximate to and facing the outer diameter 290' of the ring 30' body 270', and a trailing surface 1004' opposite the leading surface 1000' and facing the inner diameter 294' of the body 270'. Each tooth also narrows as it extends axially from the body 270'.

The leading surface 316' is substantially convex, extending outwardly away from the tooth 286. In the illustrated embodiment the leading surface 316' includes a pair of planar surfaces set at an angle relative to one another to form a point 1008' and facing radially outwardly. More specifically, the planar surfaces are oriented such that they extend away from each other as they extend radially inwardly. In alternative embodiments, the leading surface 316' may include a single, convex curved surface as well.

The trailing surface 1004' is substantially concave, extending inwardly into the tooth 286. In the illustrated embodiment, the trailing surface 1004' includes a curved concave surface. However, in alternative embodiments multiple planar surfaces may also be used.

The gullets 128' of the ring 30' each include a low point or bottom 336" that, when installed on a base 18, is below the top plane 96. In the illustrated embodiment, the bottom 336' of the gullet 128' is coincident with the top surface 296' of the body 270'. Furthermore, the illustrated ring 30" includes the same number of gullets 128' as the number of gaps 208 in the dome 26. In alternative embodiments, the ring 30' may include a number of gullets 128' that is a multiple of the number of gaps 208 in the dome 26.

Figure 18:
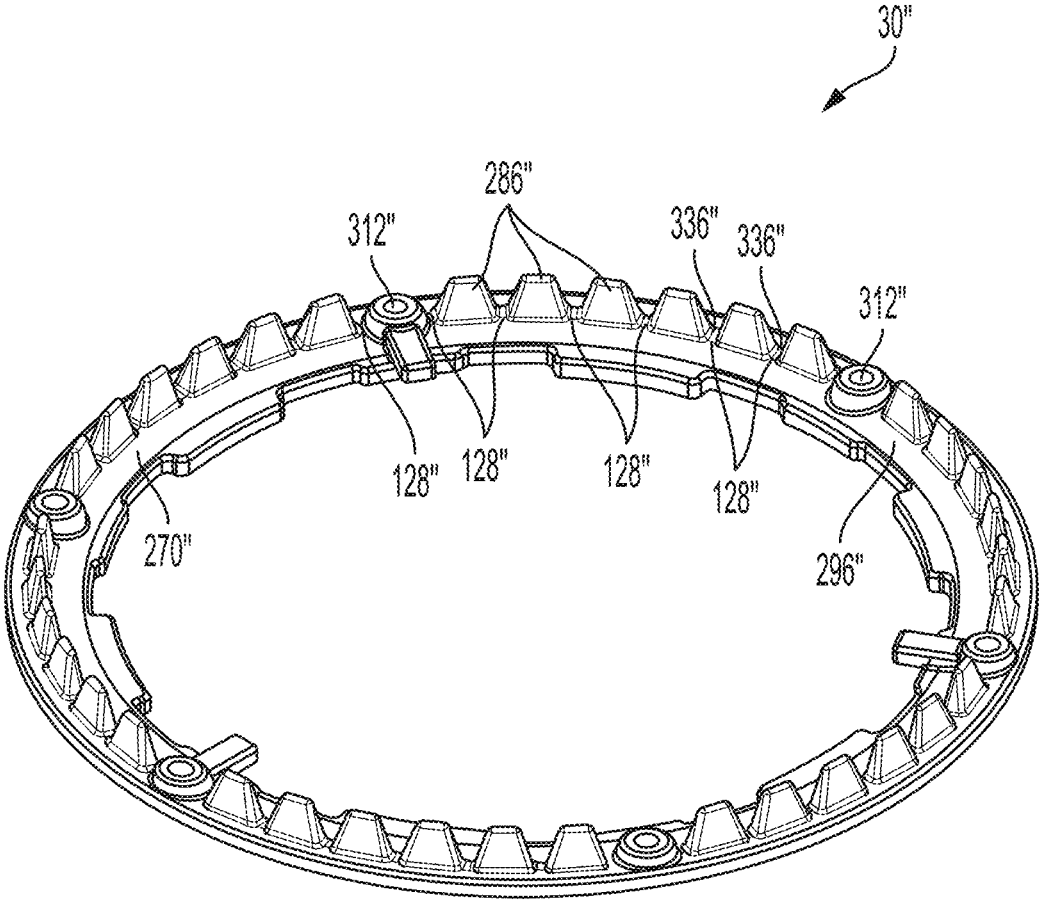
FIG. 18 is a perspective view of another embodiment of a gravel ring.
Figure 19:
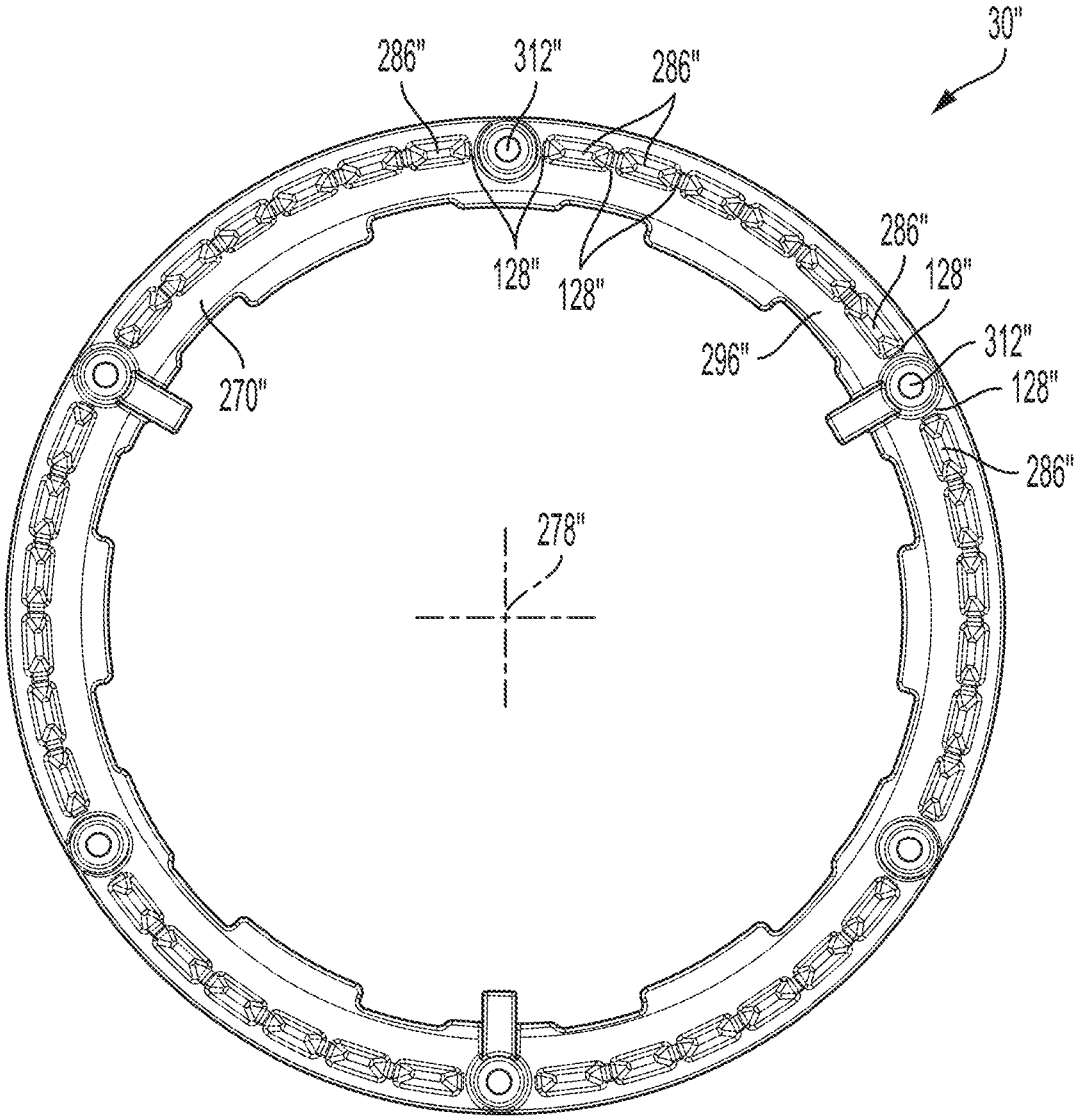
FIG. 19 is a top view of the gravel ring of FIG. 18.
Figure 20:
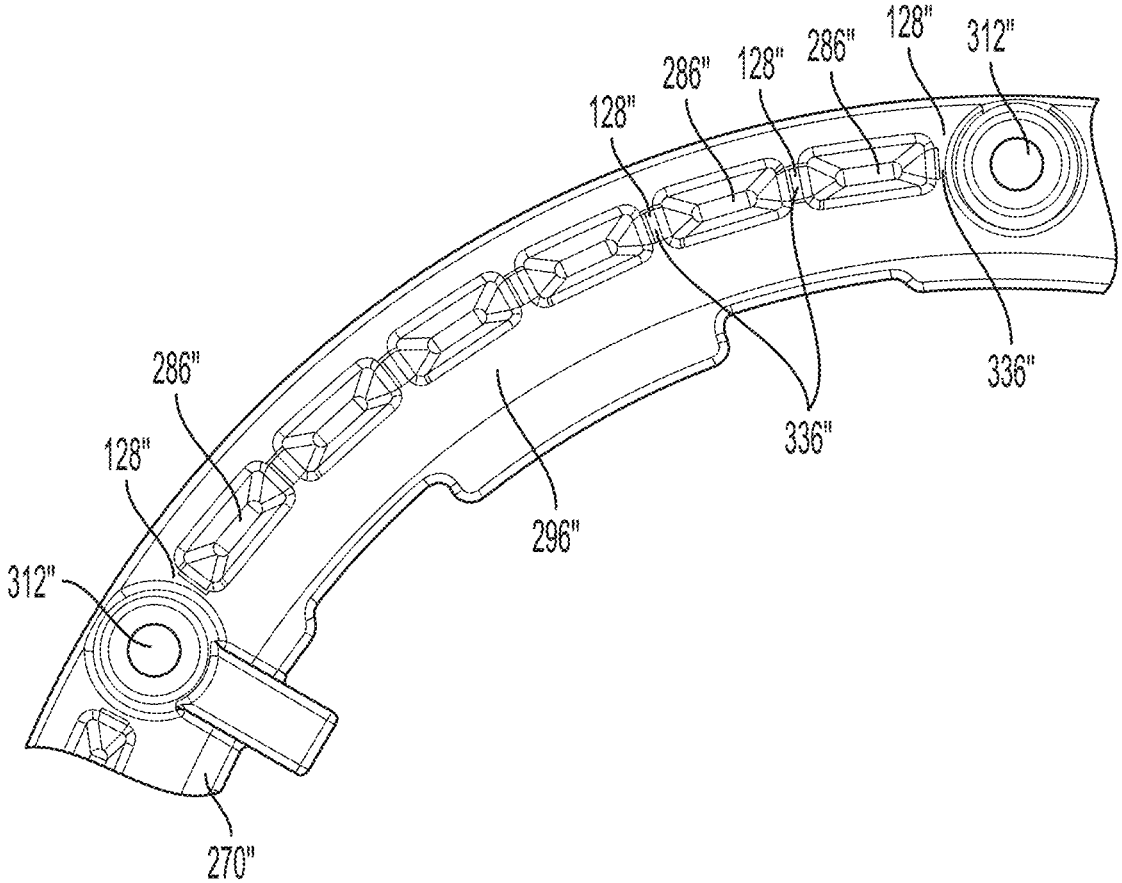
FIG. 20 is a detailed top view taken from FIG. 19.

FIGS. 18-20 illustrate another embodiment of the gravel ring 30". The gravel ring 30" is substantially similar to the gravel ring 30 so only the differences will be discussed in detail herein. The gravel ring 30" includes a plurality of teeth 286", and one or more bolt apertures 312". Together, the teeth 286" and bolt apertures 312" are equally spaced along the circumference of the body 270" of the ring 30" with a gullet 128" being formed between each item. As shown in FIG. 19, both the teeth 286" and bolt apertures 312" are all located substantially the same radial distance from the axis 278".

The gullets 128" of the ring 30" each include a low point or bottom 336" that, when installed on a base 18, is below the top plane 96. In the illustrated embodiment, the bottom 336" of the gullet 128" is coincident with the top surface 296" of the body 270". Furthermore, the illustrated ring 30" includes the same number of gullets 128" as the number of gaps 208 in the dome 26. In alternative embodiments, the ring 30" may include a number of gullets 128" that is a multiple of the number of gaps 208.

The teeth 286" of the ring 30" are substantially rectangular in shape having a wider circumferential dimension than radial dimension. Each tooth 286" also narrows as it extends axially from the top surface 296" of the body 270". While the illustrated teeth 286" are rectangular, in alternative embodiments, different shapes may be used. In still other embodiments, the size and shape of the teeth 286" may vary on a single ring 30" (e.g., a portion of the teeth 286" are rectangular, a portion are diamond, and the like).

Figure 21:
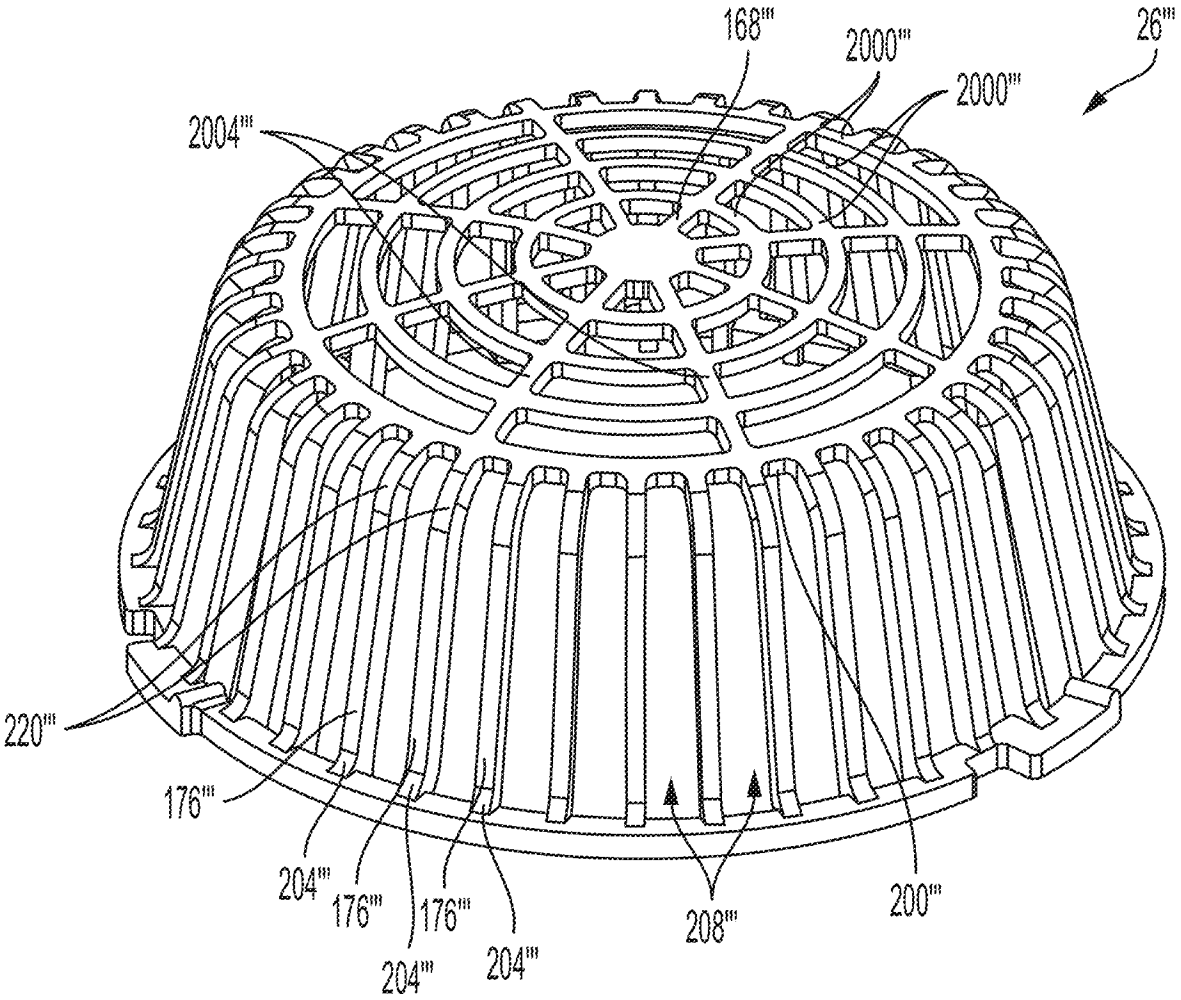
FIG. 21 is a perspective view of another embodiment of a dome.

FIG. 21 illustrates another embodiment of the dome 26'''. The dome 26''' is substantially similar to the dome 26 so only the differences will be discussed herein. The core element 168''' of the dome 26''' includes a plurality of concentric rings 2000''' interconnected by a plurality of radially expending splines 2004''' to produce an outer core diameter 200'''. The dome 26''' also includes a plurality of ribs 176''' extending radially outwardly from the core element 168''' to produce a corresponding distal end 204'''. The dome 26''' does not include any crossbeams outside the core element 168'''. Furthermore, the dome 26''' does not include any crossbeams proximate the transition 220''' of each rib 176'''. Stated differently, the gaps 208''' between each rib 176''' is not covered proximate the transition 220'''.

Figure 28:
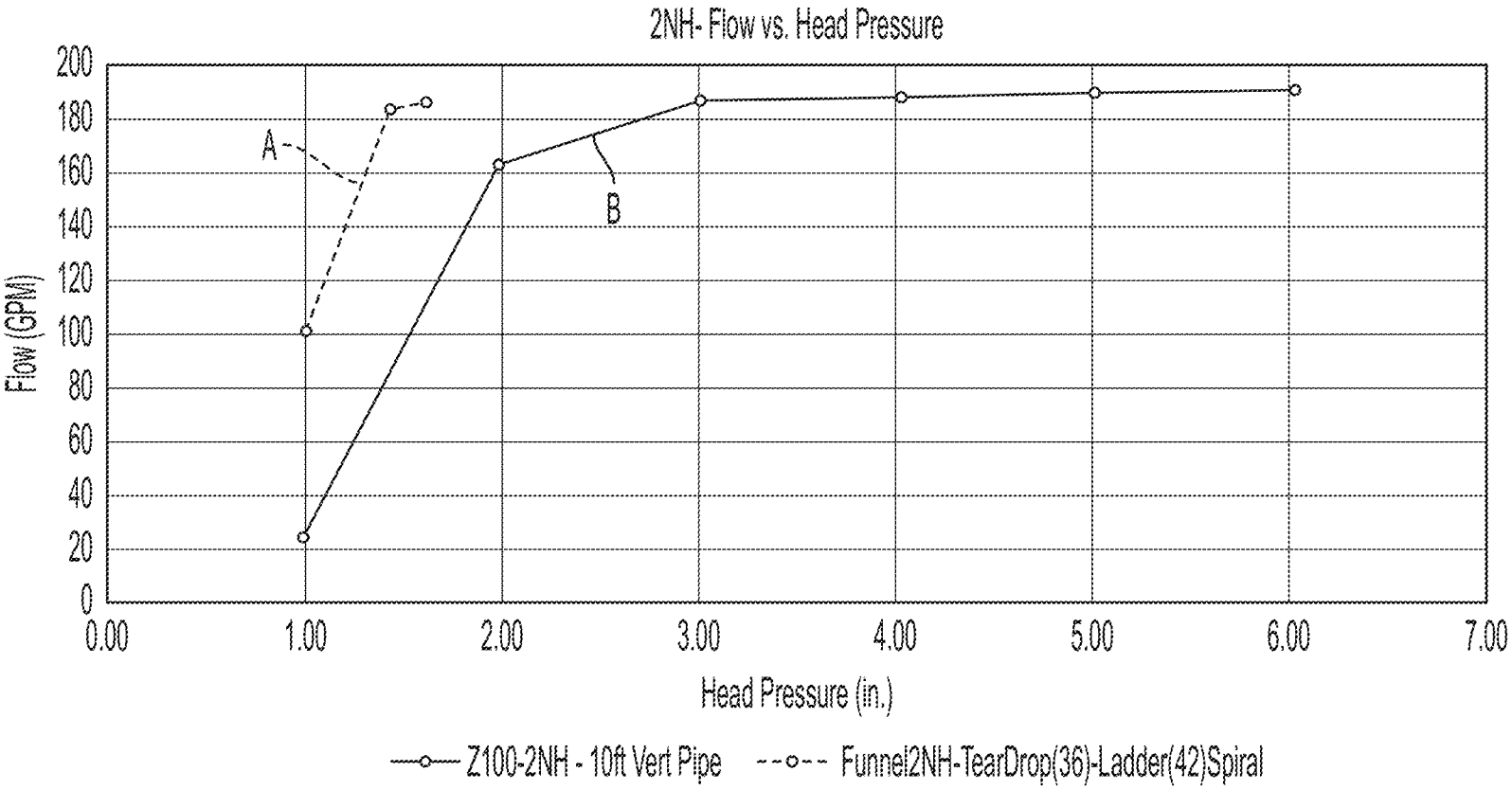
FIGS. 28-30 illustrate flow data generally corresponding to an embodiment of the roof drain.
Figure 29:
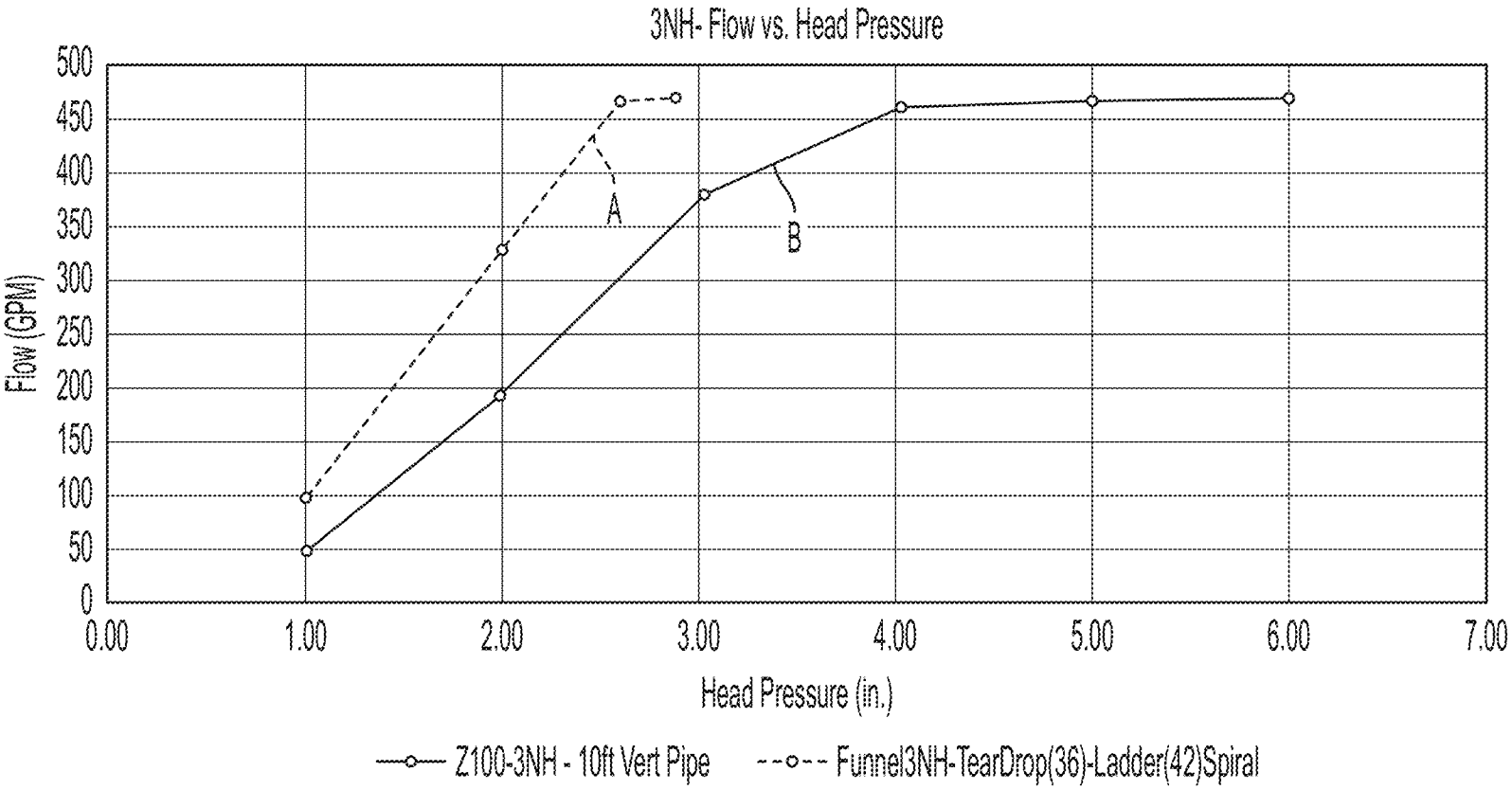
Figure 30:
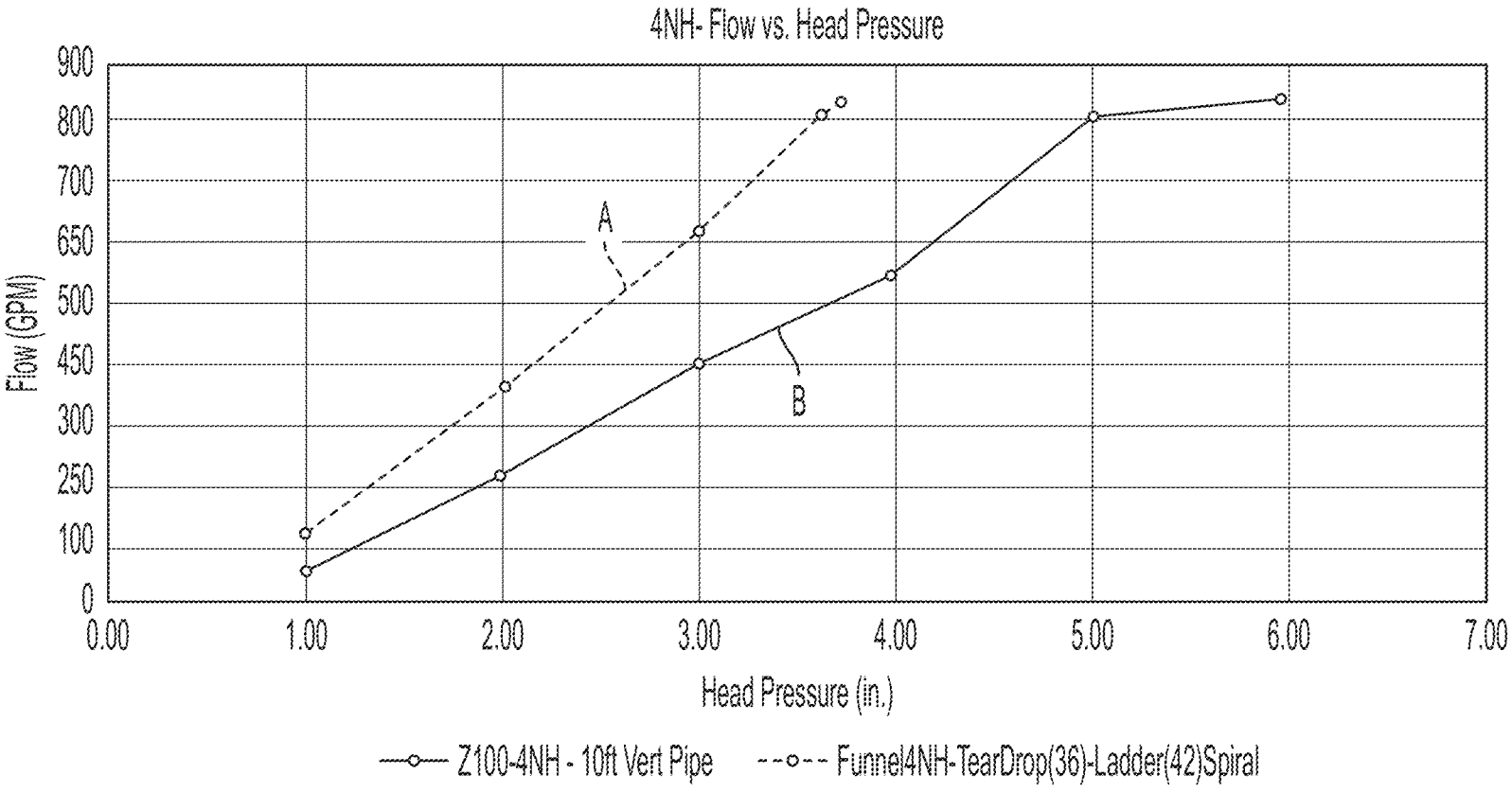
Figure 31:
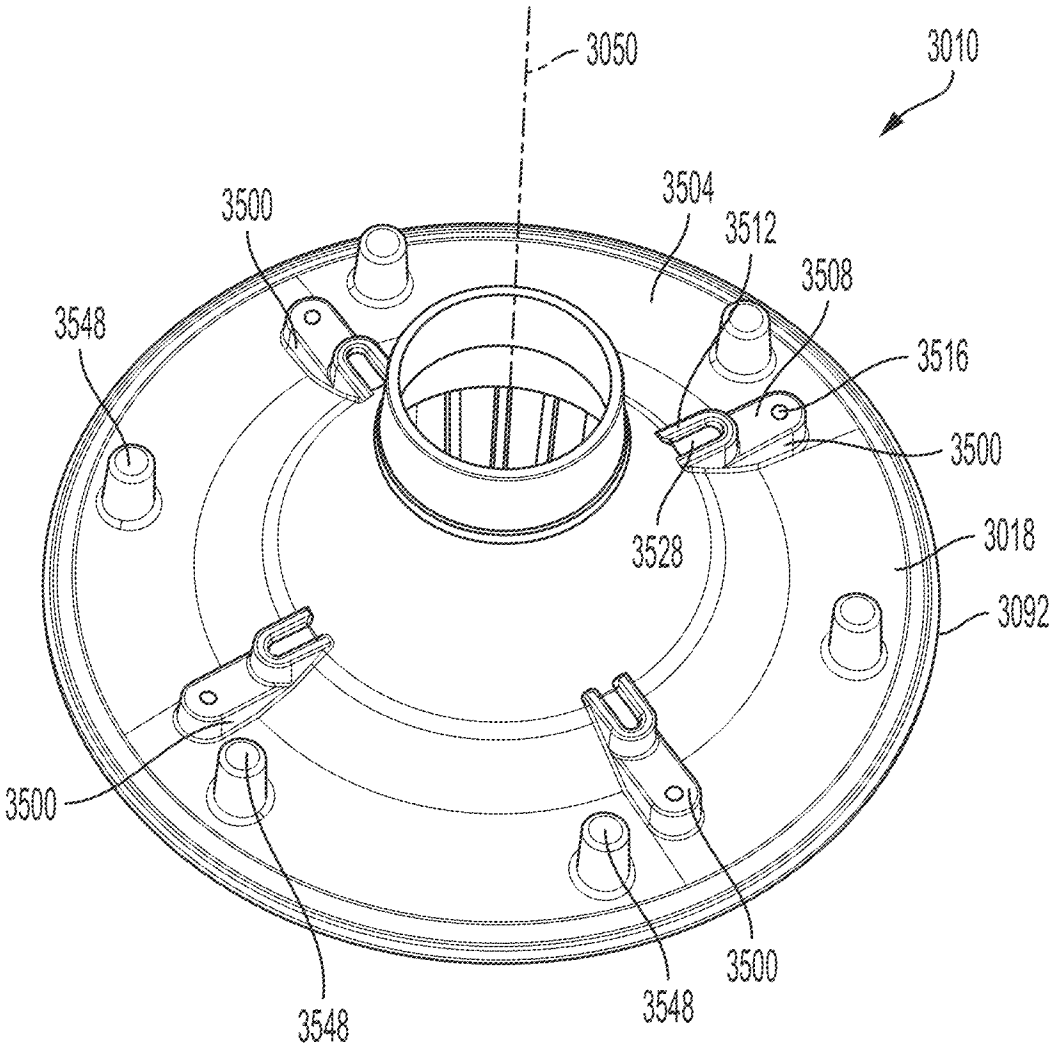
FIGS. 31-34 illustrate another embodiment of the roof drain.

FIGS. 28-30 illustrate the flow characteristics of some embodiments of the drain 10 (identified as line "A") as compared to a traditional roof drain (identified as line "B"). In some embodiments, the drain 10 is configured to flow between 75 and 150 GPM at 1" of head pressure. For the purposes of this application, the head pressure is measured as the depth of the water above the top plane 96 of the drain 10. In other embodiments, the drain 10 is configured to flow between 90 and 110 GPM at 1" of head pressure. In still other embodiments, the drain 10 is configured to flow between 75 and 100 GPM at 1" of head pressure. In still other embodiments, the drain 10 is configured to flow approximately 100 GPM at 1" of head pressure. In still other embodiments, the drain 10 is configured to flow at least 75 GPM at 1" of head pressure. In still other embodiments, the drain 10 is configured to flow at least 100 GPM at 1" of head pressure.

In still other embodiments, the drain 10 is configured to flow between 40 and 120 GPM at 1" of head pressure with an output diameter 24 of 2". In another embodiment, the drain 10 is configured to flow between 80 and 180 GPM at 1" of head pressure with an output diameter 24 of 2". In still other embodiments, the drain 10 is configured to flow between 90 and 110 GPM at 1" of head pressure with an output diameter 24 of 2". In still other embodiments, the drain 10 is configured to flow approximately 100 GPM at 1" of head with an output diameter 24 of 2".

In still other embodiments, the drain is configured to flow between 225 and 400 GPM at 2" of head pressure with an outlet diameter 24 of 4". In still other embodiments, the drain 10 is configured to flow between 225 and 375 GPM at 2" of head pressure with an outlet diameter 24 of 4". In still other embodiments, the drain 10 is configured to flow between 300 and 400 GPM at 2" of head pressure with an outlet diameter 24 of 4". In still other embodiments, the drain 10 is configured to flow between 350 and 400 GPM at 2" of head with an outlet diameter 24 of 4". In still other embodiments, the drain 10 is configured to flow approximately 350 GPM at 2" of head with an outlet diameter 24 of 4". In still other embodiments, the drain 10 is configured to flow greater than 225 GPM at 2" of head pressure with an outlet of 4". In still other embodiments, the drain 10 is configured to flow at least 250 GPM at 2" of head pressure with an outlet diameter of 4". In still another embodiment, the drain 10 is configured to flow at least 250 GPM at 2" of head with an outlet of at least 3".

In still other embodiments, the drain 10 is configured to flow between 200 and 350 GPM at 2" of head pressure with an outlet diameter 24 of 3". In still other embodiments, the drain 10 is configured to flow between 200 and 325 GPM at 2" of head pressure with an outlet diameter 24 of 3". In still other embodiments, the drain 10 is configured to flow between 300 and 400 GPM at 2" of head pressure with an outlet diameter 24 of 3". In still other embodiments, the drain 10 is configured to flow between 300 and 350 GPM at 2" of head pressure with an outlet diameter 24 of 3". In still other embodiments, the drain 10 is configured to flow approximately 325 GPM at 2" of head pressure with an outlet diameter of 3". In still other embodiments, the drain 10 is configured to flow greater than or equal to 325 GPM at 2" of head pressure with an outlet diameter of 3". In still other embodiments, the drain 10 is configured to flow at least 200 GPM at 2" of head pressure with an outlet diameter of 3".

In still other embodiments, the drain 10 is configured to reach 90% maximum flow rate at less than 2" of head pressure. For the purposes of this application, the maximum flow rate of the drain 10 is generally defined as the maximum rate of flow that can pass through the drain 10 having a downpipe with a diameter equal to the outlet diameter 24 of the outlet 22 attached thereto.

In still other embodiments, the drain 10 is configured to reach 90% maximum flow rate at less than 2" of head pressure with an outlet diameter of 2". In still other embodiments, the drain 10 is configured to reach 90% maximum flow rate at between 1" and 2" of head pressure with an outlet diameter of 2". In still other embodiments, the drain 10 is configured to reach 90% maximum flow rate at 1.5" of head pressure or less with an outlet diameter 24 of 2". In still other embodiments, the roof drain is configured to reach 90% maximum flow rate at less than 2" of head pressure with an outlet diameter of 2".

In still other embodiments, the drain 10 is configured to reach 90% maximum flow rate at less than 5" of head pressure with an outlet diameter 24 of 4". In still other embodiments, the drain 10 is configured to reach 90% maximum flow rate at between 3" and 4" of head pressure with an outlet diameter 24 of 4". In still other embodiments, the drain 10 is configured to reach 90% maximum flow rate at between 3.5" and 4" of head pressure with an outlet diameter 24 of 4". In still other embodiments, the drain 10 is configured to reach 90% maximum flow rate at approximately 3.5" of head pressure with an outlet diameter 24 of 4". In still other embodiments, the drain 10 is configured to reach 90% maximum flow rate at less than 4" of head pressure with an outlet diameter 24 of 4". In still other embodiments, the drain 10 is configured reach 90% maximum flow rate at less than 4.5" of head pressure with an outlet diameter of 4".

In still some embodiments, the drain 10 is configured to reach 90% maximum flow rate at less than 4" of head pressure with an outlet diameter 24 of 3". In still other embodiments, the drain 10 is configured to reach 90% maximum flow rate at less than 3" of head pressure with an outlet diameter 24 of 3". In still other embodiments, the drain 10 is configured to reach 90% maximum flow rate at between 2" and 3" of head pressure with an outlet diameter 24 of 3". In still other embodiments, the drain 10 is configured to reach 90% maximum flow rate at between 2.5" and 3" of head pressure with an outlet diameter 24 of 3". In still other embodiments, the drain 10 is configured to reach 90% maximum flow rate at approximately 2.5" of head pressure with an outlet diameter 24 of 3". In still other embodiments, the drain 10 is configured to reach 90% maximum flow rate at less than 3.5" of head pressure with an outlet diameter of 3".

In some embodiments, the flow rates set forth above may be determined by attaching a 10 foot long vertically oriented downpipe to the outlet 22 of the drain 10 and then running a test measuring the flow rate through the drain 10 and downpipe. In such embodiments, the 10 foot long vertically oriented downpipe would have a size substantially corresponding to the outlet diameter 24 of the drain 10. Furthermore, in some embodiments the roof drain may be installed in a test stand according industry standard ASME A112.6.4. Similarly, a test protocol to gather the data may also be conducted in accordance with ASME A112.6.4.

Figure 36:
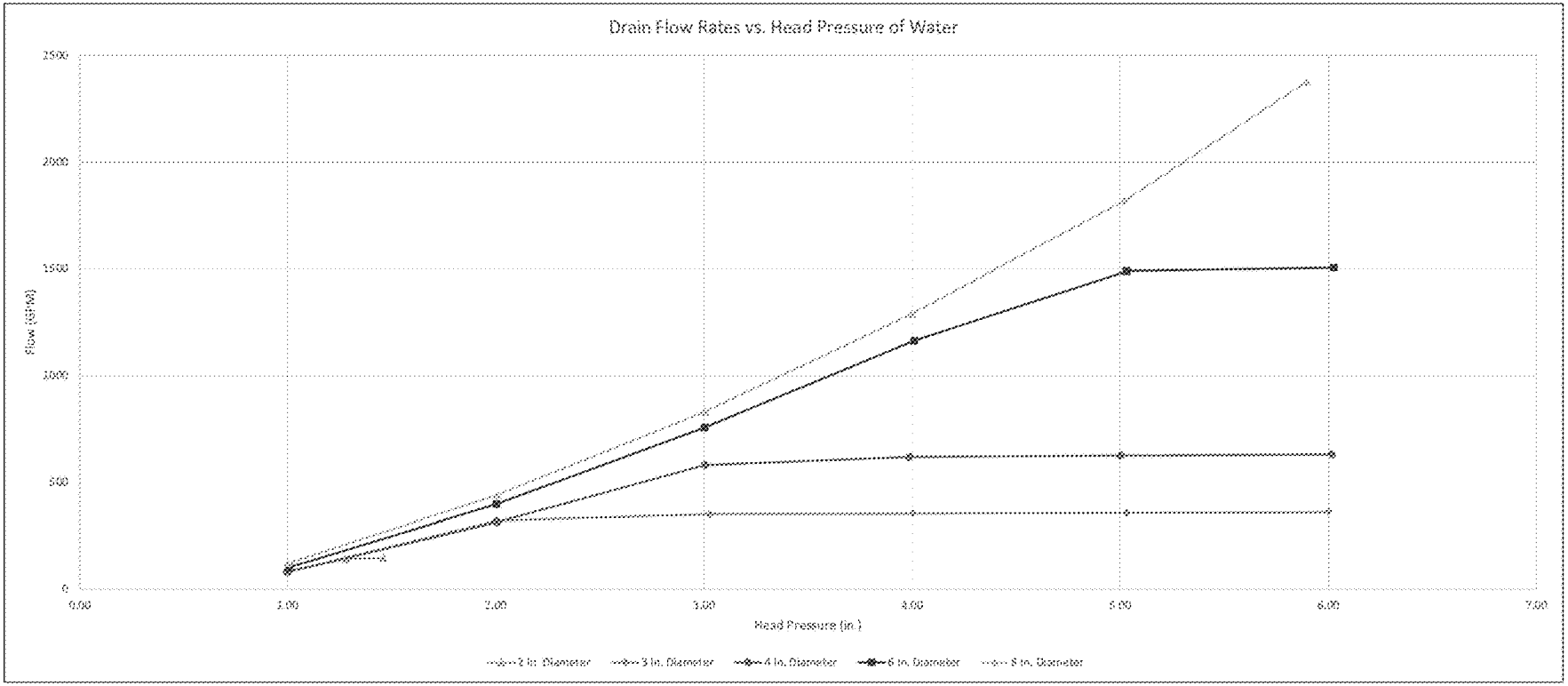

FIGS. 35 and 36 illustrate the flow characteristics of the drain 10 when tested having a 4 foot long vertically oriented drain pipe with the indicated output diameter attached thereto. The tests were conducted in accordance with standard ASME A112.6.4 as it pertains to gravity roof drains. The drain 10 is configured so that it will not transition from gravity flow characteristics to siphonic flow characteristics, under testing conditions, for at least 5 minutes. All head pressures are measured relative to the top plane 96.

In some embodiments, the drain 10 is configured to flow between 80 GPM and 125 GPM at 1 inch of head pressure. In still other embodiments, the drain 10 is configured to flow between 150 GPM and 445 GPM at 2 inches of head pressure. In still other embodiments, the drain 10 is configured to flow between 300 GPM and 350 GPM at 2 inches of head pressure. In still other embodiments, the drain 10 is configured to flow between 310 GPM and 330 GPM at 2 inches of head pressure.

In some embodiments, the drain 10 is configured to flow between 80 and 90 GPM at 1 inch of head pressure with an outlet diameter 24 of 2". In still other embodiments, the drain 10 is configured to flow approximately 85 GPM at 1 inch of head pressure with an outlet diameter 24 of 2". In still other embodiments, the drain 10 is configured to flow between 140 and 150 GPM with an outlet diameter 24 of 2". In still other embodiments, the drain 10 is configured to achieve 90% maximum flow at less than 1.5 inches of head pressure and an outlet diameter 24 of 2". In still other embodiments, the drain 10 is configured to achieve 90% maximum flow at less than 1.28 inches of head pressure and an outlet diameter 24 of 2".

In some embodiments, the drain 10 is configured to flow between 80 and 150 GPM at 1 inch of head pressure with an outlet diameter 24 of 3". In still other embodiments, the drain 10 is configured to flow approximately 81 GPM at 1 inch of head pressure with an outlet diameter 24 of 3". In still other embodiments, the drain 10 is configured to flow between 310 and 350 GPM at 2 inches of head pressure with an outlet diameter 24 of 3". In still other embodiments, the drain 10 is configured to flow approximately 320 GPM at 2 inches of head pressure with an outlet diameter 24 of 3". In still other embodiments, the drain 10 is configured to flow between 320 and 400 GPM with an outlet diameter 24 of 3". In still other embodiments, the drain 10 is configured to flow between 340 and 360 GPM with an outlet diameter 24 of 3". In still other embodiments, the drain 10 is configured to flow approximately 360 GPM with an outlet diameter 24 of 3". In still other embodiments, the drain 10 is configured to achieve 90% maximum flow at 2 inches or less of head pressure and an outlet diameter 24 of 3". In still other embodiments, the drain 10 is configured to achieve 90% maximum flow at 3 inches or less of head pressure and an outlet diameter 24 of 2".

In some embodiments, the drain 10 is configured to flow between 80 and 100 GPM at 1 inch of head pressure with an outlet diameter 24 of 4". In still other embodiments, the drain 10 is configured to flow approximately 81 GPM at 1 inch of head pressure with an outlet diameter 24 of 4". In still other embodiments, the drain 10 is configured to flow between 300 and 600 GPM at 2 inches of head pressure with an outlet diameter 24 of 4". In still other embodiments, the drain 10 is configured to flow between 300 and 350 GPM at 2 inches of head pressure with an outlet diameter 24 of 4". In still other embodiments, the drain 10 is configured to flow approximately 314 GPM at 2 inches of head pressure with an outlet diameter 24 of 4". In still other embodiments, the drain 10 is configured to flow between 600 and 650 GPM with an outlet diameter 24 of 4". In still other embodiments, the drain 10 is configured to flow between 620 and 350 GPM with an outlet diameter 24 of 4". In still other embodiments, the drain 10 is configured to flow approximately 630 GPM with an outlet diameter 24 of 4". In still other embodiments, the drain 10 is configured to achieve 90% maximum flow at 3 inches or less of head pressure and an outlet diameter 24 of 4".

In some embodiments, the drain 10 is configured to flow between 100 and 130 GPM at 1 inch of head pressure with an outlet diameter 24 of 6". In still other embodiments, the drain 10 is configured to flow approximately 102 GPM at 1 inch of head pressure with an outlet diameter 24 of 6". In still other embodiments, the drain 10 is configured to flow between 350 and 700 GPM at 2 inches of head pressure with an outlet diameter 24 of 6". In still other embodiments, the drain 10 is configured to flow between 375 and 425 GPM at 2 inches of head pressure with an outlet diameter 24 of 6". In still other embodiments, the drain 10 is configured to flow approximately 400 GPM at 2 inches of head pressure with an outlet diameter 24 of 6". In still other embodiments, the drain 10 is configured to flow between 1400 and 1600 GPM with an outlet diameter 24 of 6". In still other embodiments, the drain 10 is configured to flow approximately 1500 GPM with an outlet diameter 24 of 6". In still other embodiments, the drain 10 is configured to achieve 90% maximum flow at 4 inches or less of head pressure and an outlet diameter 24 of 6". In still other embodiments, the drain 10 is configured to achieve 90% maximum flow at 4.5 inches of head pressure and an outlet diameter 24 of 6".

In some embodiments, the drain 10 is configured to flow between 100 and 130 GPM at 1 inch of head pressure with an outlet diameter 24 of 8". In still other embodiments, the drain 10 is configured to flow approximately 122 GPM at 1 inch of head pressure with an outlet diameter 24 of 8". In still other embodiments, the drain 10 is configured to flow between 400 and 500 GPM at 2 inches of head pressure with an outlet diameter 24 of 8". In still other embodiments, the drain 10 is configured to flow between 420 and 480 GPM at 2 inches of head pressure with an outlet diameter 24 of 8". In still other embodiments, the drain 10 is configured to flow approximately 440 GPM at 2 inches of head pressure with an outlet diameter 24 of 8". In still other embodiments, the drain 10 is configured to flow between 2000 and 2500 GPM with an outlet diameter 24 of 8". In still other embodiments, the drain 10 is configured to flow approximately 2300 GPM with an outlet diameter 24 of 8". In still other embodiments, the drain 10 is configured to achieve 90% maximum flow at 5.5 inches or less of head pressure and an outlet diameter 24 of 8".

FIGS. 31-34 illustrate another embodiment of the drain 3010. The drain 3010 is substantially similar to the drain 10 so only the differences will be discussed in detail herein. The drain 3010 includes one or more bosses 3500 extending axially from the underside 3504 of the base 3018 of the drain 3010. Each boss 3500, in turn, defines a first surface 3508 oriented substantially perpendicular to the central axis 3050 of the base 3018, and a second surface 3512 oriented substantially perpendicular to the central axis 3050 and spaced axially from the first surface 3508. More specifically, the second surface 3512 is positioned axially below and radially inwardly of the first surface 3508.

Figure 32:
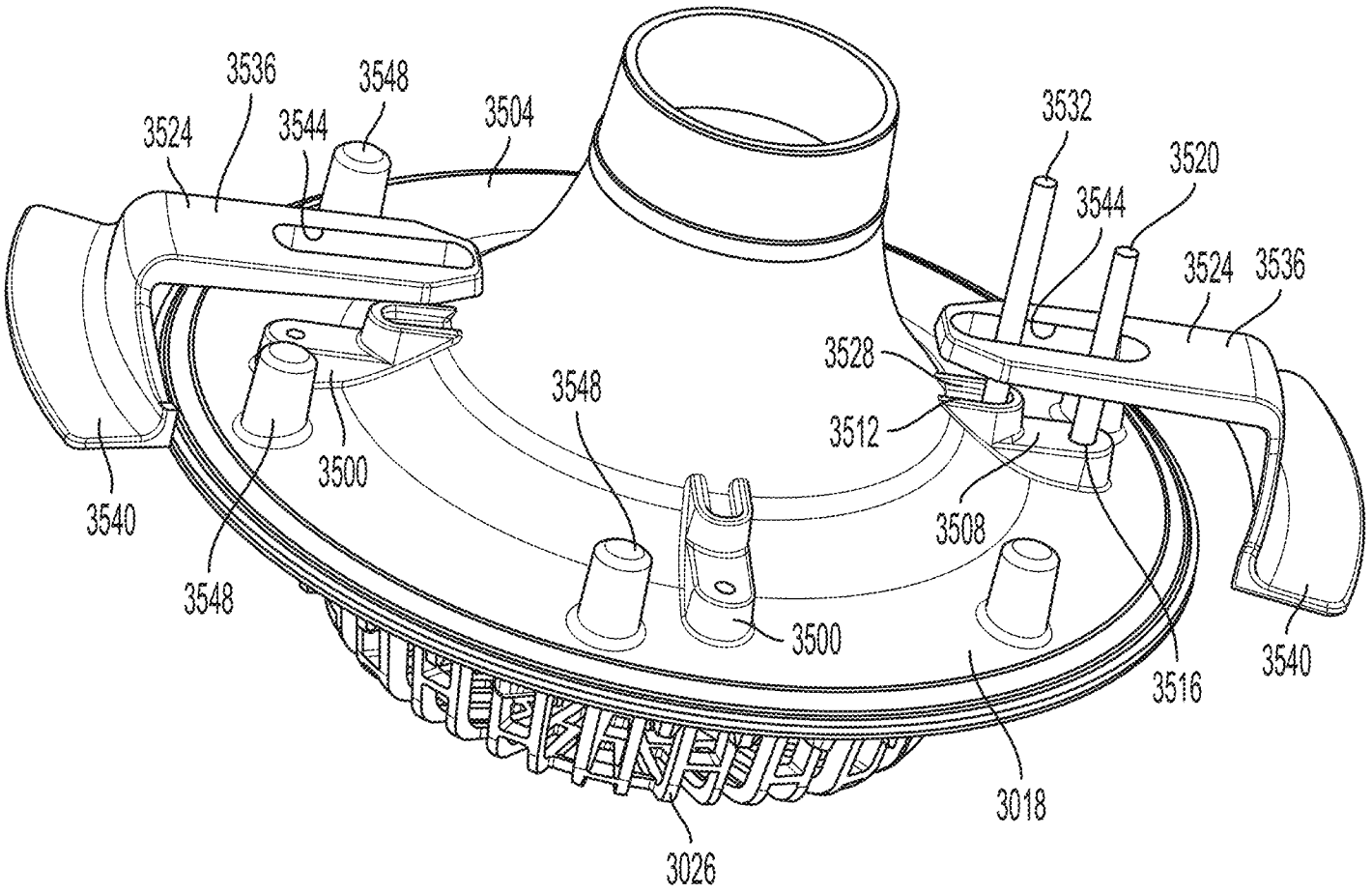

As shown in FIG. 32, the first surface 3508 defines a threaded aperture 3516 configured to receive a fastener 3520 therein for coupling a connection member 3524 to the base 3018. The second surface 3512, in turn, defines a slot 3528 radially aligned with the aperture 3516 of the first surface 3508. Together, the aperture 3516 and the slot 3528 help radially orient the connection member 3524 relative to the base 3018 of the drain 3010 by receiving a pin 3532 or other alignment member therein. While the illustrated drain 3010 includes four bosses 3500 formed therein, in alternative embodiments more or fewer bosses 3500 may be present.

The drain 3010 also includes one or more connection members 3524 configured to releasably secure the drain 3010 to a roof 14, alignment plate (not shown) or other support surface. Each connection member 3524 includes a first leg 3536 and a locking flange 3540. As shown in FIG. 32, the locking flange 3540 is radially and axially offset from the first leg 3536 and configured to contact the underside of the roof 14 or support surface. While the illustrated locking flange 3540 is substantially arcuate in shape, in other embodiments the flange 3540 may include teeth, texture, protrusions, and the like as necessary to interact with the underside of the support surface or roof 14.

As shown in FIG. 32, the first leg 3536 of the connection member 3524 defines an elongated slot 3544 sized to align with both the aperture 3516 and the slot 3528 of the boss 3500 and allow a fastener 3520 and/or pin 3532 to pass therethrough. The slot 3544 is configured to allow the connection member 3524 to be adjusted radially relative to the base 3018 during the installation process.

The drain 3010 also includes a plurality of stand-offs 3548 extending axially from the underside 3504 of the base 3018. The stand-offs 3548 are substantially cylindrical in shape and positioned equally along the outer edge 3092 of the base 3018. During use, the stand-offs 3548 are configured to engage the roof 14 or support surface and secure the base 3018 relative thereto.

Figure 33:
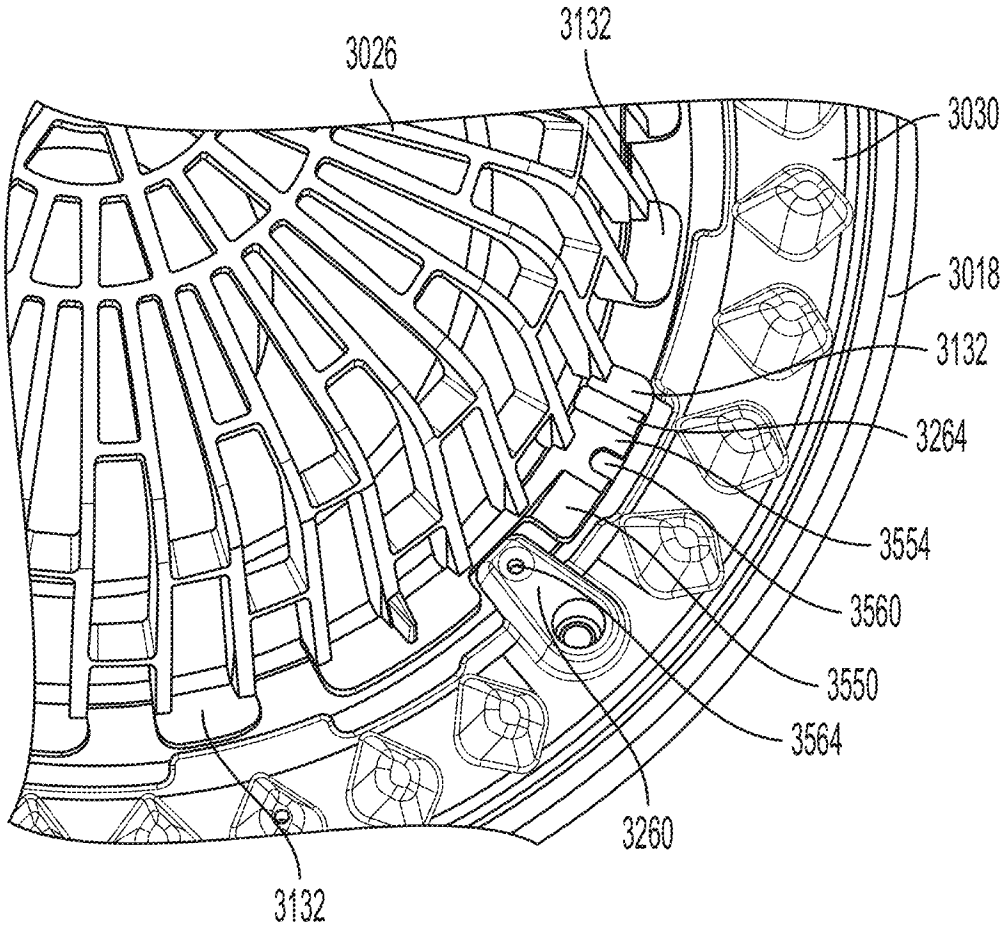
Figure 34:
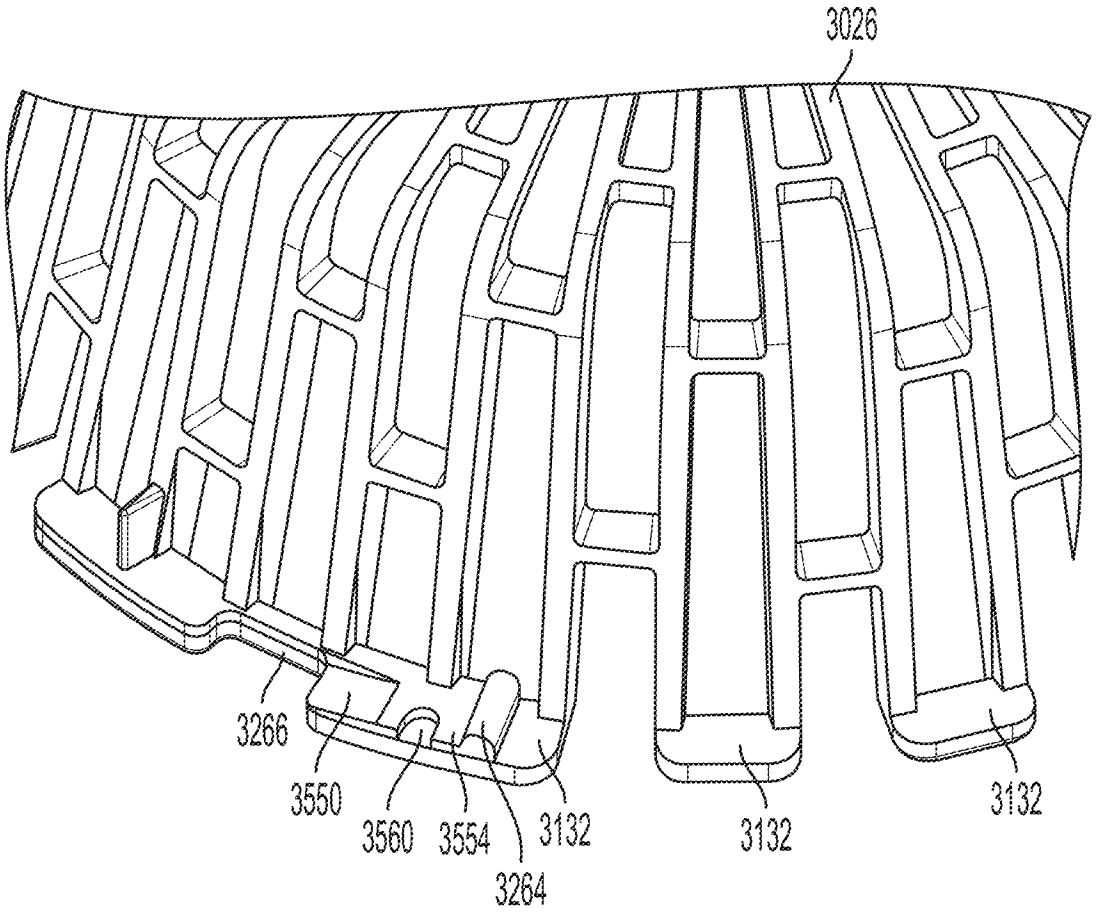

As shown in FIG. 33, the first set of base plates 3132 of the cage 3026 of the drain 3010 include a ramped surface 3550 configured to assist the locking member 3260 to travel up and onto the top of the base plate 3132 to engage the locking ridge 3264. More specifically, the ramped surface 3550 is formed into the base plates 3132 proximate the locking notch 3266 so that, when the user rotates the cage 3026 relative to the gravel ring 3030, the locking 3260 travels along the surface 3550 to the upper side 3554. This makes it easier for the user to lock the cage 3026 relative to the base 3018 and also allows for a tighter fit between the two elements 3026, 3018 once the connection has been made.

The first set of base plate 3132 also includes a locking notch 3560 formed into the upper side 3554 of the base plate 3132. When assembled, the locking notch 3560 substantially aligns with a corresponding aperture 3564 of the locking member 3260 such that the user may insert a fastener or pin through the aperture 3564 where it is at least partially received within the locking notch 3560 to rotational lock the cage 3026 relative to the ring 3030.

Although the invention has been described in detail with reference to certain preferred embodiments, variations and modifications exist within the scope and spirit of one or more independent aspects of the invention as described.

The invention claimed is:

1. A roof drain comprising:

a base having a throat portion and a flange portion extending radially outwardly from the throat portion, the throat portion at least partially defining a channel therethrough, an axis, and an outlet;

a gravel guard ring coupled to the base, including a plurality of teeth, and a plurality of ring locking members, wherein a plurality of gullets are defined between the teeth; and a dome releasably coupled to the base with a plurality of dome locking members, the dome including a plurality of spaced ribs extending radially outwardly from a core element and defining gaps therebetween, and a plurality of crossbars extending between and interconnecting some adjacent ribs, the crossbars are positioned such that each crossbar is not aligned with any crossbars positioned in adjacent gaps, wherein the plurality of dome locking members rotationally engage the plurality of ring locking members to releasably couple the dome to the base.

2. The roof drain of claim 1, wherein the base defines a top plane, and wherein at least one gullet of the plurality of gullets at least partially extends axially below the top plane.

3. The roof drain of claim 1, wherein the base defines a top plane, wherein the dome includes a plurality of base plates extending between at least two adjacent ribs, and wherein at least one base plate of the plurality of base plates is positioned completely axially below the top plane.

4. The roof drain of claim 1, wherein the channel includes an inner surface, and wherein the inner surface is substantially convex in shape.

5. The roof drain of claim 1, wherein the base includes a cutting groove.

6. The roof drain of claim 5, wherein the cutting groove is positioned radially inward of an outer diameter of the dome.

7. The roof drain of claim 1, wherein the base defines a top plane, and wherein the drain is capable of permitting through-flows of between 75 GPM and 150 GPM at 1 inch of head pressure measured relative to the top plane.

8. The roof drain of claim 1, wherein each gullet is radially aligned with a corresponding gap.

9. The roof drain of claim 1, wherein at least one gap between adjacent ribs is open at the bottom of the dome.

* * * * *